US007695878B2

(12) United States Patent
Seshita et al.

(10) Patent No.: US 7,695,878 B2
(45) Date of Patent: Apr. 13, 2010

(54) IMAGE FORMING APPARATUS, PROCESS CARTRIDGE AND TONER FOR USE IN THE IMAGE FORMING APPARATUS

(75) Inventors: Takuya Seshita, Hiratsuka (JP); Toyoshi Sawada, Yokohama (JP); Tomomi Suzuki, Numazu (JP); Tsuneyasu Nagatomo, Numazu (JP); Satoshi Kojima, Numazu (JP)

(73) Assignee: Ricoh Company Limited, Tokyo (JP)

( * ) Notice: Subject to any disclaimer, the term of this patent is extended or adjusted under 35 U.S.C. 154(b) by 375 days.

(21) Appl. No.: 11/687,404

(22) Filed: Mar. 16, 2007

(65) Prior Publication Data

US 2007/0218383 A1 Sep. 20, 2007

(30) Foreign Application Priority Data

Mar. 17, 2006 (JP) ..... 2006-074534

(51) Int. Cl.
*G03G 9/087* (2006.01)

(52) U.S. Cl. ..... 430/108.1; 430/110.3; 430/110.4; 399/111; 399/222

(58) Field of Classification Search ..... 430/108.1, 430/110.3, 110.4, 109.4; 399/111, 222
See application file for complete search history.

(56) References Cited

U.S. PATENT DOCUMENTS 5,403,690 A 4/1995 Kuramoto et al.
5,554,478 A 9/1996 Kuramoto et al.
5,840,456 A 11/1998 Tomita et al.
6,074,794 A 6/2000 Fushimi et al.
6,303,258 B1 10/2001 Katoh et al.
6,566,026 B2 5/2003 Watanabe et al.
6,653,037 B2 11/2003 Sawada et al.
6,716,561 B2 4/2004 Shiraishi et al.

(Continued)

FOREIGN PATENT DOCUMENTS

JP 63-319037 12/1988

(Continued)

OTHER PUBLICATIONS

U.S. Appl. No. 12/035,862, filed Feb. 22, 2008, Nagatomo, et al.

(Continued)

*Primary Examiner*—John L Goodrow
(74) *Attorney, Agent, or Firm*—Oblon, Spivak, McClelland, Maier & Neustadt, L.L.P.

(57) ABSTRACT

An image forming apparatus including an image bearer; a charging device charging the image bearer; a light irradiating device irradiating the charged image bearer with light to form an electrostatic image; a developing device developing the electrostatic image with a developer including a toner to form a toner image on the image bearer; a transfer device transferring the toner image; and a cleaning device cleaning the image bearer, wherein the volume average particle diameter of the toner is greater than 5.0 μm and less than 5.5 μm, the content of toner particles having a particle diameter of not greater than 4.0 μm is not higher than 20% by number, the ratio of the first shape factor SF-1 to the second shape factor SF-2 is from 1.00 to 1.15, and the content of toner particles having a SF-2 of not less than 115 is not less than 67.8% by number.

22 Claims, 13 Drawing Sheets

U.S. PATENT DOCUMENTS

| | | | | |
|---|---|---|---|---|
| 6,757,507 | B2 | 6/2004 | Mochizuki et al. | |
| 6,770,411 | B2 | 8/2004 | Masuda et al. | |
| 6,818,369 | B2 | 11/2004 | Sugiura et al. | |
| 6,821,698 | B2 | 11/2004 | Sawada et al. | |
| 6,830,859 | B2 | 12/2004 | Shiraishi et al. | |
| 6,852,459 | B2 | 2/2005 | Katoh et al. | |
| 6,858,365 | B2 | 2/2005 | Sawada et al. | |
| 6,861,191 | B2 | 3/2005 | Mochizuki et al. | |
| 6,902,858 | B2 | 6/2005 | Mochizuki et al. | |
| 6,939,653 | B2 | 9/2005 | Suzuki et al. | |
| 6,977,129 | B2 | 12/2005 | Saito et al. | |
| 7,024,140 | B2 | 4/2006 | Masuda et al. | |
| 7,049,037 | B2 | 5/2006 | Katoh et al. | |
| 7,052,815 | B2 | 5/2006 | Sawada et al. | |
| 7,132,210 | B2 | 11/2006 | Suzuki et al. | |
| 7,163,774 | B2 | 1/2007 | Shiraishi et al. | |
| 7,169,522 | B2 | 1/2007 | Sugiura et al. | |
| 2001/0044059 | A1 | 11/2001 | Miyamoto et al. | |
| 2002/0098436 | A1 | 7/2002 | Miyamoto et al. | |
| 2002/0142243 | A1* | 10/2002 | Hirose et al. | 430/110.3 |
| 2003/0152857 | A1 | 8/2003 | Sugiura et al. | |
| 2003/0180643 | A1 | 9/2003 | Suzuki et al. | |
| 2004/0076901 | A1 | 4/2004 | Miyamoto et al. | |
| 2004/0126138 | A1* | 7/2004 | Furuki et al. | 399/149 |
| 2004/0234879 | A1 | 11/2004 | Hasegawa et al. | |
| 2005/0008961 | A1 | 1/2005 | Takada et al. | |
| 2005/0112488 | A1 | 5/2005 | Yamada et al. | |
| 2005/0186498 | A1 | 8/2005 | Honda et al. | |
| 2005/0214670 | A1 | 9/2005 | Matsumoto et al. | |
| 2005/0250037 | A1* | 11/2005 | Sawada et al. | 430/109.4 |
| 2005/0277046 | A1 | 12/2005 | Sawada et al. | |
| 2006/0024097 | A1 | 2/2006 | Yamada et al. | |
| 2006/0063081 | A1 | 3/2006 | Nagatomo et al. | |
| 2006/0093946 | A1 | 5/2006 | Miyamoto et al. | |
| 2006/0204883 | A1 | 9/2006 | Nakayama et al. | |
| 2006/0210334 | A1 | 9/2006 | Tokumasu et al. | |
| 2006/0285897 | A1 | 12/2006 | Sugiura et al. | |

FOREIGN PATENT DOCUMENTS

| | | |
|---|---|---|
| JP | 1-257857 | 10/1989 |
| JP | 6-317928 | 11/1994 |
| JP | 10-142897 | 5/1998 |
| JP | 2000-112169 | 4/2000 |
| JP | 2001-13732 | 1/2001 |
| JP | 2002-55580 | 2/2002 |
| JP | 2002-156877 | 5/2002 |
| JP | 2002-229227 | 8/2002 |
| JP | 2002-244487 | 8/2002 |
| JP | 2002-244516 | 8/2002 |
| JP | 2004-53956 | 2/2004 |
| JP | 2005-55783 | 3/2005 |

OTHER PUBLICATIONS

U.S. Appl. No. 12/026,937, filed Feb. 6, 2008, Seshita, et al.
U.S. Appl. No. 12/040,451, filed Feb. 29, 2008, Saitoh, et al.
U.S. Appl. No. 12/042,041, filed Mar. 4, 2008, Yamada, et al.
U.S. Appl. NO. 12/046,011, filed Mar. 11, 2008, Nagatomo, et al.
U.S. Appl. No. 11/852,778, filed Sep. 10, 2007, Nagatomo, et al.
U.S. Appl. No. 11/855,806, filed Sep. 14, 2007, Awamura, et al.
U.S. Appl. No. 11/856,379, filed Sep. 17, 2007, Sawada, et al.
U.S. Appl. No. 11/857,791, filed Sep. 19, 2007, Kojima, et al.
U.S. Appl. No. 12/209,583, filed Sep. 12, 2008, Seshita, et al.
U.S. Appl. No. 12/260,493, filed Oct. 29, 2008, Sawada, et al.

* cited by examiner

CONTENT OF PARTICLES HAVING SF-2 NOT LESS THAN 165 ≧
0.136 × CONTENTS OF PARTICLES HAVING SF-1 NOT LESS THAN 165 − 1.1929

IMAGE FORMING APPARATUS, PROCESS CARTRIDGE AND TONER FOR USE IN THE IMAGE FORMING APPARATUS

BACKGROUND OF THE INVENTION

1. Field of the Invention

The present invention relates to an image forming apparatus, and more particularly to an image forming apparatus having an image bearing member, a charging device, a developing device, a transfer device and a cleaning device. In addition, the present invention also relates to a toner for use in the image forming apparatus, and a process cartridge.

2. Discussion of the Background

Electrophotographic image forming methods have been used for various fields. Electrophotographic image forming methods typically include the following processes.

(1) charging the surface of an image bearing member such as photoreceptors (charging process):

(2) irradiating the charged image bearing member with light to form an electrostatic latent image on the image bearing member (light irradiating process);

(3) developing the electrostatic latent image with a developer including a toner to form a toner image on the image bearing member (developing process);

(4) transferring the toner image onto a receiving material fed from a sheet feeding device optionally via an intermediate transfer medium (transfer process);

(5) fixing the toner image to the receiving material upon application of heat and pressure thereto (fixing process); and (6) removing toner particles remaining on the image bearing member and intermediate transfer medium without being transferred so that the image bearing member and intermediate transfer medium are ready for the next image forming processes (cleaning process).

Image forming apparatuses performing such processes are broadly classified into revolver-type image forming apparatuses in which plural developing devices are arranged around one image bearing member and tandem-type image forming apparatuses which plural image bearing members are serially arranged together with respective developing devices to form respective color images. Revolver-type image forming apparatuses have an advantage of low cost. In contrast, tandem-type image forming apparatuses have an advantage of high speed printing but have a relatively high cost. Recently, tandem-type image forming apparatuses are in the mainstream because of being able to perform high speed printing.

Examples of image forming apparatuses are illustrated in FIGS. 1-3.

Referring to FIG. 1, the image forming apparatus includes an image bearing member 7; a charging device 1 configured to charge the surface of the image bearing member 7; a light irradiating device 2 configured to irradiate the charged image bearing member 7 with imagewise light to form an electrostatic latent image thereon; a developing device 3 configured to develop the electrostatic latent image with a developer (such as one-component developers including a toner and no carrier, and two component developers including a toner and a carrier) to form a toner image on the image bearing member 7; a transfer device 4 configured to transfer the toner image to a sheet of a receiving material fed from a sheet feeding device 9; a cleaning device including a cleaner 6 and an auxiliary cleaner 5, which are configured to remove residual toner particles from the image bearing member 7; and a fixing device 8 configured to fix the toner image on the sheet of the receiving material.

Specific examples of the charging device 1 include short-range chargers, contact chargers and corona chargers, which apply a DC voltage or a DC voltage overlapped with an AC voltage.

Specific examples of the light irradiating device 2 include devices using a laser diode (LD), a light emitting diode (LED), a xenon lamp or the like.

Specific examples of the developing device 3 include one-component developing devices using a one-component developer, and two-component developing devices using a two-component developer.

Specific examples of the transfer device 4 include devices including a transfer belt, a transfer charger, a transfer roller or the like.

Specific examples of the auxiliary cleaner 5 include fur brushes, elastic rollers, rollers covered with a tube, devices having a non-woven cloth or the like. As illustrated in FIG. 2, plural auxiliary cleaners can be provided. In contrast, the image forming apparatus illustrated in FIG. 3 includes no auxiliary cleaner.

Specific examples of the cleaner 6 include cleaning blades which are typically made of a material such as polyurethane rubbers, silicone rubbers, nitrile rubbers and chloroprene rubbers.

Blade cleaning methods have been typically used for conventional image forming apparatuses, and there are many image forming apparatuses having only a cleaning blade. In addition, there are high speed image forming apparatuses having a cleaning device having a blade and a brush located on an upstream side from the blade to prevent a situation in that a large amount of residual toner particles are present at a surface of the image bearing member.

With respect to toner for use in the developer, pulverization toners have been used for conventional image forming apparatus. However, in order to produce high quality images and to improve transferability of toner, recently toners with a small particle diameter and spherical toners have been developed and used. For example, published unexamined Japanese patent application No. (hereinafter referred to as JP-A) 01-257857 discloses a spherical toner which is prepared by a wet method such as suspension polymerization and emulsion polymerization. In addition, published examined Japanese patent application No. 04-27897 and JP-A 06-317928 have disclosed spherical toners, which are prepared by subjecting pulverized toners to a heat treatment.

However, small toners and spherical toners tend to have a drawback in that residual toner particles present on the surface of an image bearing member escape through a cleaning blade, resulting in defective cleaning (i.e., resulting in occurrence of a background development problem in that the background of an image is soiled with toner particles). When a high pressure is applied to a cleaning blade to prevent such a problem, an excessive shearing force is applied to a portion of the blade, thereby causing chipping (i.e., omission of a portion) of the cleaning blade, resulting in occurrence of defective cleaning. Alternatively, problems in that the cleaning blade and/or the image bearing member are seriously abraded occur.

When a cleaning blade is seriously abraded, the area of the contact point between the blade and the image bearing member increases, resulting in decrease of the pressure of the cleaning blade to the image bearing member. Therefore, a problem in that small toners or spherical toners cannot be well removed from the image bearing member occurs. Thus, it is hard to well remove a small-size toner or a spherical toner.

In attempting to prevent abrasion of a cleaning blade to which a high pressure is applied, JP-As 2002-244516, 2002-156877, 2002-55580, and 2002-244487 have disclosed techniques in that a lubricant is applied to the surface of the image bearing member to be cleaned by the blade.

In addition, in attempting to prolong the lives of a charging device and an image bearing member, JP-A 2002-229227 discloses a technique in that a non-contact charging device and an image bearing member having a photosensitive layer including a particulate inorganic material are used while applying a lubricant such as zinc stearate to the image bearing member.

Further, JP-A 10-142897 discloses an image forming apparatus in which a lubricant applied to the surface of an image bearing member is smoothed (or large particles of the lubricant is blocked) by a blade at a location between a charging device and a developing device.

However, image forming apparatuses having a lubricant applicator tend to have the following drawbacks.

(1) When an excessive amount of lubricant is applied to an image bearing member, the charging roller contacted with the image bearing member is contaminated, thereby causing defective charging, resulting in formation of abnormal images.

(2) Since the lubricant applied to an image bearing member is mixed with the developer used, the toner in the developer is prevented from being well charged, and thereby electrostatic latent images on the image bearing member cannot be well developed, resulting in formation of abnormal images.

(3) Setting of a lubricant applicator in an image forming apparatus increases the size and costs of the apparatus.

Thus, a technique of controlling application of a lubricant to an image bearing member has not yet established. Namely, when a lubricant applicator is provided in an image forming apparatus, various problems are caused. Therefore, it is preferable to provide no lubricant applicator in an image forming apparatus in view of reduction in size and costs of the image forming apparatus.

In attempting to well remove a small toner and/or a spherical toner on an image bearing member with a cleaning blade while preventing abrasion of the cleaning blade and occurrence of the size and const problems, the following proposals have been made.

JP-A 2005-55783 discloses a toner in which plural kinds of same-polarity charge controlling agents are present on the surface of the toner and which includes an external additive, wherein the toner has a volume average particle diameter of not greater than 10 μm, and a shape factor of not greater than 180.

JP-A 2000-112169 discloses a toner in which a particulate auxiliary material is present on the surface of toner particles and which has a shape factor of from 100 to 150.

Spherical toner which is prepared by forming toner particles in an aqueous medium and which has a relatively large average particle diameter tends to be well removed from an image bearing member with a blade because such toner has a small amount of fine toner particles. However, when a small-size spherical toner is used to produce high quality images, toner particles on an image bearing member are not often removed well (i.e., the toner has a low margin for cleanability) because such toner tends to include fine toner particles (having a volume particle diameter of not greater than 4 μm) in an amount of not less than 20% by number.

In attempting to remedy the drawback of the above-mentioned small spherical toner (having a volume average particle diameter (Dv) of from 5.0 to 5.5 μm), a technique in that the content of fine toner particles (having a volume particle diameter of not greater than 4 μm) is reduced to 10% by number or less by classification is proposed. It is described therein that such toner has good blade cleanability. However, performing such a classification operation increases costs and production time of the toner while decreasing yield. Therefore, it is desirable not to perform such a classification operation.

Because of these reasons, a need exists for a technique by which a toner having a volume average particle diameter (Dv) of from 5.0 to 5.5 μm and including fine toner particles having a volume particle diameter of not greater than 4 μm in an amount of not less than 20% by number can be used without causing cleaning problems.

SUMMARY OF THE INVENTION

As an aspect of the present invention, an image forming apparatus is provided which includes at least an image bearing member, a charging device configured to charge the image bearing member, a light irradiating device configured to irradiate the charged image bearing member with light to form an electrostatic latent image on the image bearing member, a developing device configured to develop the electrostatic latent image with a developer including a toner to form a toner image on the image bearing member, a transfer device configured to transfer the toner image onto a receiving material optionally via an intermediate transfer medium, and a cleaning device configured to remove toner particles remaining on the image bearing member without being transferred, wherein the toner satisfies the following relationships (1)-(4):

$$5.0\mu m < Dv < 5.5\mu m; \quad (1)$$

$$C_4 \geqq 20\% \text{ by number}; \quad (2)$$

$$1.00 < SF\text{-}1/SF\text{-}2 < 1.15; \text{ and} \quad (3)$$

$$C_{SF2\text{-}115} \geqq 67.8\% \text{ by number}, \quad (4)$$

wherein Dv represents the volume average particle diameter of the toner, $C_4$ represents the content of toner particles having a particle diameter of not greater than 4.0 μm, SF-1 and SF-2 represent the first and second shape factors of the toner, respectively, and $C_{SF2\text{-}115}$ represents the content of toner particles having a SF-2 of not less than 115.

In the image forming apparatus, the image bearing member and at lest one of the charging device, developing device, and cleaning device can be unitized to be detachably attached to the image forming apparatus.

As another aspect of the present invention, a toner is provided which satisfies the above-mentioned relationships (1)-(4). The toner is preferably prepared by a method including a step of forming toner particles in an aqueous medium.

As yet another aspect of the present invention, a process cartridge is provided which includes at least an image bearing member and a developing device, wherein the toner satisfies the above-mentioned relationships (1)-(4), and wherein the process cartridge is detachably attached to an image forming apparatus as a unit.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
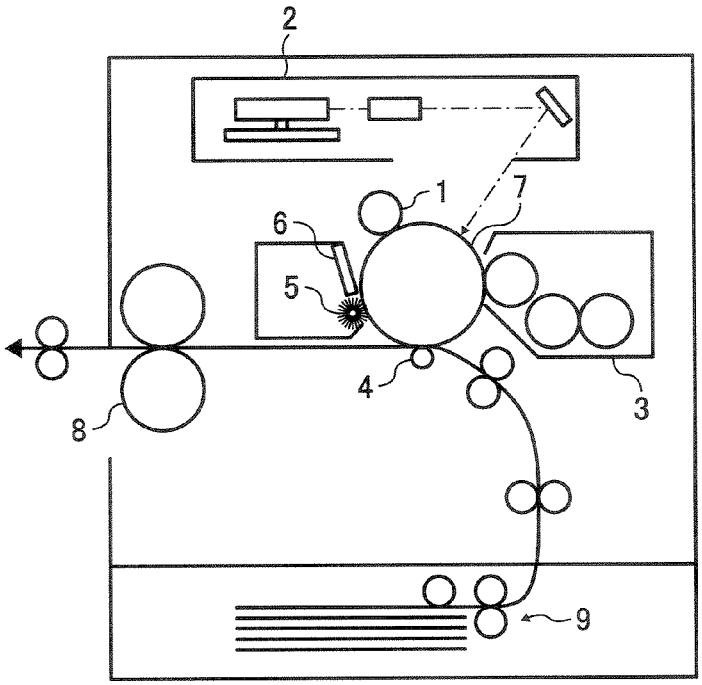
FIG. 1 is a schematic view illustrating an image forming apparatus having one auxiliary cleaner.
Figure 2:
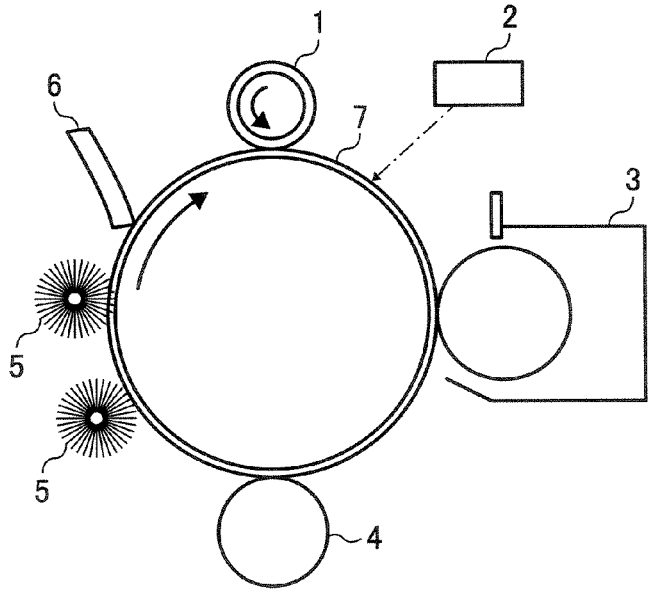
FIG. 2 is a schematic view illustrating an image forming apparatus having two auxiliary cleaners.
Figure 3:
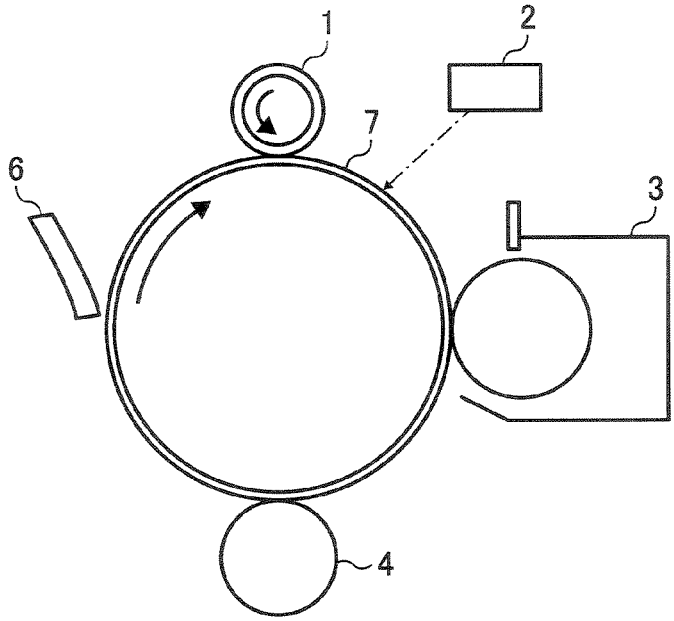
FIG. 3 is a schematic view illustrating an image forming apparatus having no auxiliary cleaner.

The present inventors try to establish a technique of producing high quality images using such a small-size spherical toner as mentioned above without increasing the contact pressure of a cleaning blade (i.e., without accelerating abrasion of a cleaning blade). As a result of the present inventors' study, it is found that when a toner satisfying specific relationships concerning shape factors is used, occurrence of the cleaning problems can be prevented.

The present invention will be explained in detail.

The image forming apparatus of the present invention includes at least an image bearing member, a charging device configured to charge the image bearing member, a light irradiating device configured to irradiate the charged image bearing member with light to form an electrostatic latent image on the image bearing member, a developing device configured to develop the electrostatic latent image with a developer including a toner to form a toner image on the image bearing member, a transfer device configured to transfer the toner image onto a receiving material optionally via an intermediate transfer medium, and a cleaning device configured to remove toner particles remaining on the image bearing member without being transferred, wherein the toner satisfies the following relationships (1)-(4):

$$5.0\mu m < Dv < 5.5\mu m; \quad (1)$$

$$C_4 \geqq 20\% \text{ by number}; \quad (2)$$

$$1.00 < SF\text{-}1/SF\text{-}2 < 1.15; \text{ and} \quad (3)$$

$$C_{SF2\text{-}115} \geqq 67.8\% \text{ by number}, \quad (4)$$

wherein Dv represents the volume average particle diameter of the toner, $C_4$ represents the content of toner particles having a particle diameter of not greater than 4.0 μm, SF-1and SF-2 represent the first and second shape factors of the toner, respectively, and $C_{SF2\text{-}115}$ represents the content of toner particles having a SF-2 of not less than 115.

The toner is preferably prepared by a method including a step of forming toner particles in an aqueous medium.

It is preferable that the toner further satisfies the following relationship (5) in addition to the relationships (1)-(4):

$$C_{SF2\text{-}120} \geqq 40\% \text{ by number}, \quad (5)$$

wherein $C_{SF2\text{-}120}$ represents the content of toner particles having a SF-2 of not less than 120.

It is preferable that the toner further satisfies the following relationships (6) and (7) in addition to the relationships (1)-(4):

$$C_{SF1\text{-}140} \leqq 43.27\% \text{ by number, and} \quad (6)$$

$$C_{SF2\text{-}140} \geqq 3.51\% \text{ by number}, \quad (7)$$

wherein $C_{SF1\text{-}140}$ represents the content of toner particles having a SF-1 of not less than 140, and $C_{SF2\text{-}140}$ represents the content of toner particles having a SF-2 of not less than 140.

It is preferable that the toner further satisfies the following relationships (8) and (9) in addition to the relationships (1)-(4):

$$C_{SF1\text{-}145} \leqq 35.67\% \text{ by number, and} \quad (8)$$

$$C_{SF2\text{-}145} \geqq 1.17\% \text{ by number}, \quad (9)$$

wherein $C_{SF1\text{-}145}$ represents the content of toner particles having a SF-1 of not less than 145, and $C_{SF2\text{-}145}$ represents the content of toner particles having a SF-2 of not less than 145.

It is preferable that the toner further satisfies the following relationship (10) in addition to the relationships (1)-(4):

$$C_{SF2\text{-}165} \geqq 0.136 \times C_{SF1\text{-}165} - 1.1929, \quad (10)$$

wherein $C_{SF1\text{-}165}$ represents the content of toner particles having a SF-1 of not less than 165, and $C_{SF2\text{-}165}$ represents the content of toner particles having a SF-2 of not less than 165.

Figure 5:
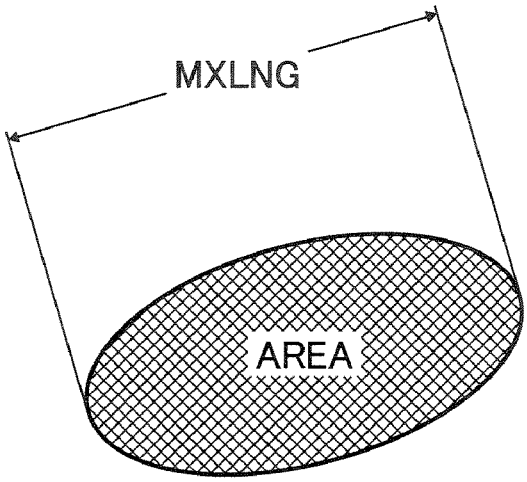
FIGS. 5 and 6 are schematic views for explaining how to determine the shape factors SF-1 and SF-2 of toner, respectively.
Figure 6:
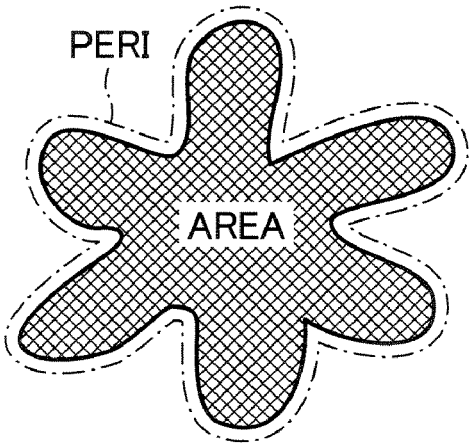

FIGS. 5 and 6 are schematic views for explaining the first and second shape factors SF-1 and SF-2 of toner, respectively.

As illustrated in FIG. 5, the first shape factor SF-1 represents the degree of the roundness of a toner and is defined by the following equation (1):

$$SF\text{-}1 = \{(MXLNG)^2/(\text{AREA})\} \times (100\pi/4) \quad (1)$$

wherein MXLNG represents a diameter of the circle circumscribing the image of a toner particle, which image is obtained by observing the toner particle with a microscope; and AREA represents the area of the image.

When the SF-1 is 100, the toner particle has a true spherical form. As the SF-1 increases, the toner particles have more irregular forms.

As illustrated in FIG. 6, the second shape factor SF-2 represents the degree of the concavity and convexity of a toner particle, and is defined by the following equation (2):

$$SF\text{-}2=\{(PERI)^2/(\text{AREA})\}\times(100/4\pi) \quad (2)$$

wherein PERI represents the peripheral length of the image of a toner particle observed by a microscope; and AREA represents the area of the image.

When the SF-2 approaches 100, the toner particles have a smooth surface (i.e., the toner has few concavity and convexity). As the SF-2 increases, the toner particles have a rougher surface.

The first and second shape factors SF-1 and SF-2 are determined by the following method:

(1) particles of a toner are photographed using a scanning electron microscope (FE-SEM) (S-4200, manufactured by Hitachi Ltd.); and (2) photograph images of randomly selected 300 toner particles are analyzed using an image analyzer (LUZEX AP manufactured by Nireco Corp.) to determine the first and second shape factors SF-1 and SF-2.

It is preferable to use the above-mentioned instrument and analyzer, but other instruments and analyzers can also be used if similar results can be obtained thereby.

When toner particles have a form near spherical form, the toner particles contact the other toner particles and a photoreceptor serving as an image bearing member at one point. Therefore, the adhesion of the toner particles to the other toner particles decreases and thereby fluidity of the toner can be enhanced. In addition, adhesion between the toner particles and the photoreceptor decreases, resulting in enhancement of the transferability of the toner particles. When one of the first and second shape factors SF-1 and SF-2 is greater than 180, the transferability toner deteriorates.

The reason why it is preferable for the toner to satisfy the above-mentioned relationships will be explained.

Since the toner of the present invention satisfies the above-mentioned relationships, i.e., since a large amount of deformed toner particles are included in the toner of the present invention, the toner has a cleanability similar to pulverization toners. Therefore, toner particles of the toner of the present invention can be blocked by a cleaning blade, and thereby the toner has good cleanability. In other words, when the relationships are not satisfied, the toner cannot be well blocked by a cleaning blade, and thereby toner particles escape through the cleaning blade, resulting in defective cleaning.

Therefore, even when a toner having a volume average particle diameter of greater than 5.0 μm and less than 5.5 μm, a SF-1/SF-2 ratio of greater than 1.00 and less than 1.15 and including toner particles having a particle diameter of not greater than 4.0 μm in an amount of not less than 20% by number is used, the toner has good cleanability if the toner satisfies the relationship (4). Therefore, high quality images having good fine dot reproducibility can be produced without causing the defective cleaning problem. In addition, the toner has good transferability. Thus, a toner and an image forming apparatus having good reliability in cleanability can be provided.

The toner of the present invention preferably has a volume average particle diameter of greater than 5.0 μm and less than 5.5 μm, and a ratio (Dv/Dn) of the volume average particle diameter (Dv) to the number average particle diameter (Dn) of from 1.00 to 1.40.

In general, the smaller the particle diameter of a toner, the better the resolution of the toner images but the worse the cleanability and transferability of the toner. In addition, when the volume average particle diameter (Dv) of the toner is smaller than the above-mentioned range, the toner tends to adhere to carrier particles while being fused after long term agitation in a developing device (in a case of two-component developer), resulting in deterioration of the charging ability of the carrier. In a case of one-component developer, problems in that a film of the toner is formed on the surface of a developing roller, and the toner adheres to a toner layer thickness controlling member while being fused, resulting in deterioration of image qualities.

When the toner satisfies the above-mentioned relationships (5.0 μm<Dv<5.5 μm, and 1.00≦(Dv/Dn)≦1.40), the toner can produce high quality images having high resolution. When the toner is used for a two-component developer for a long period of time while replenished, the particle diameter distribution of the toner hardly changes and therefore the toner can maintain good developability. When the ratio (Dv/Dn) is too large, the toner has a wide particle diameter distribution, and therefore the behavior of toner particles varies in a developing process. Therefore, high quality images having good fine dot reproducibility cannot be produced. The ratio (Dv/Dn) is preferably from 1.00 to 1.20 to produce higher quality images.

When the relationship (1) (5.0 μm<Dv<5.5 μm) is satisfied, fine dot images with 600 dots/inch (dpi) or more can be well reproduced. When the ratio (Dv/Dn) approaches 1.00, the toner has a sharper particle diameter distribution. Such a small toner having a sharp particle diameter distribution has a sharp charge quantity distribution, and therefore high quality images can be produced without causing the background development problem. In addition, when such a toner is used for an electrostatic transfer method, toner images on an image bearing member can be well transferred to a receiving material.

In the present application, the volume average particle diameter (Dv), number average particle diameter (Dn) and particle diameter distribution of a toner are determined by an instrument such as COULTER COUNTER TA-II and MULTISIZER II, both of which are manufactured by Beckman Coulter, Inc. The measurement method is as follows:

(1) a surfactant serving as a dispersant, preferably 0.1 to 5 ml of a 1% aqueous solution of an alkylbenzenesulfonic acid salt, is added to 100 to 150 ml of an electrolyte such as 1% aqueous solution of first class NaCl or ISOTON-II manufactured by Beckman Coulter, Inc.;

(2) 2 to 20 mg of a sample (i.e., a toner) to be measured is added into the mixture;

(3) the mixture is subjected to an ultrasonic dispersion treatment for about 1 to 3 minutes; and (4) the volume average particle diameter distribution and number average particle diameter distribution of the toner are measured using the instrument mentioned above and an aperture of 100 μm.

The volume average particle diameter and number average particle diameter of the toner can be determined from the thus obtained volume and number average particle diameter distributions.

In this case, the particle diameter channels are following 13 channels:

2.00 μm≦C1<2.52 μm; 2.52 μm≦C2<3.17 μm; 3.17 μm≦C3<4.00 μm;

4.00 μm≦C4<5.04 μm; 5.04 μm≦C5<6.35 μm; 6.35 μm≦C6<8.00 μm;

8.00 μm≦C7<10.08 μm; 10.08 μm≦C8<12.70 μm; 12.70 μm≦C9<16.00 μm;

16.00 μm≦C10<20.20 μm; 20.20 μm≦C11<25.40 μm;

25.40 μm≦C12<32.00 μm; and 32.00 μm≦C13<40.30 μm.

Thus, particles having a particle diameter not less than 2.00 μm and less than 40.30 μm are targeted.

It is preferable that the content of toner particles having a particle diameter of not greater than 2 μm in the toner of the present invention is from 1 to 10% by number. When the content of such fine toner particles is too high, the toner adheres to carrier particles and therefore the toner cannot stably have a large charge quantity. When the ratio (Dv/Dn) or the volume average particle diameter (Dv) is too large, high quality images having high resolution cannot be produced. In addition, when a developer including the toner is used in a developing device for a long period of time while replenished, the particle diameter distribution of the toner in the developing device largely changes, resulting in variation of image qualities.

The content of such fine toner particles in a toner is determined by the following method:

(1) 100 to 150 ml of water, from which impurities have been removed, is mixed with 0.1 to 0.5 ml of a surfactant (alkylbenzene sulfonate), and 0.1 to 0.5 g of a sample is added thereto;

(2) the mixture is subjected to a dispersion treatment for 1 to 3 minutes using an ultrasonic dispersing machine to prepare a dispersion in which particles of the sample are present at a concentration of from 3,000 to 10,000 pieces/μl;

(3) the content of fine toner particles having a particle diameter of not greater than 2 μm is determined using a flow type particle image analyzer FPIA-2000 from Sysmex Corp.

The toner of the present invention is preferably prepared by the following method.

(1) Toner constituents such as a binder resin, a polyester prepolymer, a compound capable of reacting with the prepolymer to cause a molecular weight growth reaction and/or a crosslinking reaction of the prepolymer, a colorant, a release agent, and a layered inorganic compound (hereinafter referred to as a modified layered inorganic compound) in which at least part of interlayer ions is modified with an ion of an organic compound (hereinafter referred to as an organic ion), are dissolved or dispersed in an organic solvent to prepare a toner composition liquid;

(2) the toner composition liquid is subjected to a molecular weight growth reaction and/or a crosslinking reaction in an aqueous medium to prepare a dispersion; and (3) the organic solvent is removed from the dispersion to prepare dispersion of toner particles.

In this regard, the toner composition liquid preferably has a Casson yield value of from 1 to 100 Pa at 25° C.

It is more preferable that the toner of the present invention is prepared by the following method.

(1) Toner constituents such as a polyester resin, a polyester prepolymer having a nitrogen-atom-containing functional group, a compound capable of reacting with the prepolymer to cause a molecular weight growth reaction and/or a crosslinking reaction of the prepolymer, a colorant, a release agent, and a modified layered inorganic compound, are dissolved or dispersed in an organic solvent to prepare a toner composition liquid;

(2) the toner composition liquid is subjected to a molecular weight growth reaction and/or a crosslinking reaction in an aqueous medium to prepare a dispersion; and (3) the organic solvent is removed from the dispersion to prepare dispersion of toner particles.

Next, the toner constituents will be explained.

Binder Resin

Polyester Resin

At first, polyester resins for use as binder resins of the toner of the present invention will be explained.

Polyester resins can be prepared by subjecting a polyhydric alcohol and a polycarboxylic acid to a polycondensation reaction.

Suitable polyols (PO) include diols (DIO) and polyols (TO) having three or more hydroxyl groups. Preferably, diols (DIO) alone or mixtures of a diol (DIO) and a small amount of a polyol (TO) are used.

Specific examples of the diols (DIO) include alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); adducts of the bisphenols mentioned above with an alkylene oxide (e.g., ethylene oxide, propylene oxide and butylene oxide); etc.

Among these compounds, alkylene glycols having from 2 to 12 carbon atoms and adducts of bisphenols with an alkylene oxide are preferable. More preferably, adducts of bisphenols with an alkylene oxide, or mixtures of an adduct of bisphenols with an alkylene oxide and an alkylene glycol having from 2 to 12 carbon atoms are used.

Specific examples of the polyols (TO) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide; etc.

Suitable polycarboxylic acids (PC) include dicarboxylic acids (DIC) and polycarboxylic acids (TC) having three or more carboxyl groups. Preferably, dicarboxylic acids (DIC) alone or mixtures of a dicarboxylic acid (DIC) and a small amount of a polycarboxylic acid (TC) are used.

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (TC) having three or more hydroxyl groups include aromatic polycarboxylic acids having from 9 to 20 carbon atoms (e.g., trimellitic acid and pyromellitic acid).

Anhydrides or lower alkyl esters (e.g., methyl esters, ethyl esters or isopropyl esters) of the polycarboxylic acids mentioned above also serve as polycarboxylic acids (PC), and can be used for the reaction with a polyol (PO).

Suitable mixing ratio (i.e., an equivalence ratio [OH]/[COOH]) of a polyol (PO) to a polycarboxylic acid (PC) is from 2/1 to 1/1, preferably from 1.5/1 to 1/1, and more preferably from 1.3/1 to 1.02/1.

The polycondensation reaction of a polyhydric alcohol with a polycarboxylic acid is performed by heating the compounds to a temperature of from 150 to 280° C. in the presence of an esterification catalyst such as tetrabutoxytitanate and dibutyl tin oxide while removing generated water (under a reduced pressure if necessary) to prepare a polyester resin having a hydroxyl group. The hydroxyl value of the polyester resin is preferably not less than 5 mgKOH/g, and the acid value thereof is preferably from 1 to 30 mgKOH/g, and more preferably from 5 to 20 mgKOH/g. When a polyester resin having a proper acid value is used, a negative charging property can be imparted to the resultant toner. In addition, the adhesion of the toner to receiving papers can be improved, resulting in improvement of low temperature fixability of the toner. However, when the acid value is too high, the charging stability of the toner deteriorates (particularly the charging property of the toner varies when environmental conditions (such as humidity) change).

The weight average molecular weight of the polyester resin to be included in the toner of the present invention is preferably from 10,000 to 400,000, and more preferably from 20,000 to 200,000. When the weight average molecular weight is too low, the offset resistance of the toner deteriorates. In contrast, when the weight average molecular weight is too is too high, the low temperature fixability of the toner deteriorates.

The prepolymer (which is a modified polyester resin) used for preparing the toner of the present invention is preferably a polyester prepolymer having a nitrogen-atom-containing functional group. Suitable polyester prepolymers having a nitrogen-atom-containing functional group include polyester prepolymers having an isocyanate group, which can be prepared by reacting a carboxyl group or a hydroxyl group located at the end of a polyester resin (which is prepared by polycondensation reaction) with a polyisocyanate compound (PIC). In order to subject such polyester prepolymers having an isocyanate group to a molecular weight growth reaction and/or a crosslinking reaction, amines can be preferably used. In this case, urea-modified polyester resins can be provided.

Specific examples of the polyisocyanates (PIC) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic didicosycantes (e.g., tolylene diisocyanate and diphenylmethane diisocyanate); aromatic aliphatic diisocyanates (e.g., α,α,α',α'-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., [NCO]/[OH]) of a polyisocyanate (PIC) to a polyester is from 5/1 to 1/1, preferably from 4/1 to 1.2/1 and more preferably from 2.5/1 to 1.5/1. When the ratio [NCO]/[OH] is too large, the low temperature fixability of the toner deteriorates. In contrast, when the ratio is too small, the content of the urea group in the modified polyesters decreases and thereby the hot-offset resistance of the toner deteriorates.

The content of the unit obtained from a polyisocyanate (PIC) in the polyester prepolymer (A) having a polyisocyanate group is from 0.5 to 40% by weight, preferably from 1 to 30% by weight and more preferably from 2 to 20% by weight. When the content is too low, the hot offset resistance of the toner deteriorates and in addition the heat resistance and low temperature fixability of the toner also deteriorate. In contrast, when the content is too high, the low temperature fixability of the toner deteriorates.

The number of the isocyanate group included in a molecule of the polyester prepolymer (A) is not less than 1, preferably from 1.5 to 3, and more preferably from 1.8 to 2.5. When the number of the isocyanate group is too small, the molecular weight of the resultant urea-modified polyester decreases and thereby the hot offset resistance of the toner deteriorates.

Specific examples of the amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these compounds, diamines (B1) themselves and mixtures in which a diamine is mixed with a small amount of a polyamine (B2).

The mixing ratio (i.e., a ratio [NCO]/[NHx]) of the prepolymer (A) having an isocyanate group to the amine (B) is from 1/2 to 2/1, preferably from 1.5/1 to 1/1.5 and more preferably from 1.2/1 to 1/1.2. When the mixing ratio is too low or too high, the molecular weight of the resultant urea-modified polyester decreases, resulting in deterioration of the hot offset resistance of the resultant toner.

The urea-modified polyesters can include an urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the content of the urea bonding is too low, the hot offset resistance of the resultant toner deteriorates.

The urea-modified polyesters can be prepared, for example, by a method such as one-shot methods. Specifically, the polycondensation reaction of a polyhydric alcohol with a polycarboxylic acid is performed by heating the compounds to a temperature of from 150 to 280° C. in the presence of an esterification catalyst such as tetrabutoxytitanate and dibutyl tin oxide while removing generated water (under a reduced pressure if necessary) to prepare a polyester resin having a hydroxyl group. Then the polyester resin is reacted with a polyisocyanate (PIC) at a temperature of from 40 to 140° C. to prepare a polyester prepolymer (A) having an isocyanate group. Further, the polyester prepolymer (A) is reacted with an amine (B) at a temperature of from 0 to 140° C. to prepare a urea-modified polyester resin.

When a polyester prepolymer (A) is reacted with an amine (B), solvents can be used if necessary. Specific examples of such solvents include aromatic solvents such as toluene and xylene; ketones such as acetone, methyl ethyl ketone and methyl isobutyl ketone; esters such as ethyl acetate; amides such as dimethylformamide and dimethylacetamide; ethers such as tetrahydrofuran. In this regard, solvents inactive with the isocyanate used are preferably used.

The molecular weight of the urea-modified polyester can be controlled using a reaction inhibitor, if desired. Specific examples of the reaction inhibitor include monoamines (e.g., diethyle amine, dibutyl amine, butyl amine and lauryl amine), and blocked amines (i.e., ketimine compounds) prepared by blocking the monoamines mentioned above.

The weight average molecular weight of the urea-modified polyester is generally not less than 10,000, preferably from 20,000 to 10,000,000 and more preferably from 30,000 to 1,000,000. When the weight average molecular weight is too low, the hot offset resistance of the resultant toner deteriorates. The number average molecular weight of the urea-modified polyester resin is not particularly limited (i.e., the weight average molecular weight of the urea-modified polyester resin is controlled so as to fall the above-mentioned range) when an unmodified polyester resin is used in combination therewith. When a urea-modified polyester resin is used alone, the urea-modified polyester resin preferably has a number average molecular weight of from 2,000 to 15,000, more preferably from 2,000 to 10,000, and even more preferably from 2,000 to 8,000. When the molecular weight is too high, the low temperature fixability deteriorates and the glossiness of color image decreases.

In the present invention, it is preferable to use a combination of a modified polyester resin and an unmodified polyester resin as the binder resin of the toner. By using such a combination, the low temperature fixability of the toner can be improved and in addition the toner can produce color images having a high glossiness. In this regard, polyester resins modified by a bonding (such as urethane bonding) other than a urea bonding are considered as the unmodified polyester resin in the present application.

When a combination of a modified polyester resin and an unmodified polyester resin is used as the binder resin, it is preferable that the modified polyester resin is at least partially mixed with the unmodified polyester resin to improve the low temperature fixability and hot offset resistance of the toner. Namely, it is preferable that the modified polyester resin has a molecular structure similar to that of the unmodified polyester resin. The mixing ratio (U/M) of an unmodified polyester resin (U) to a modified polyester resin (M) is from 20/80 to 95/5, preferably from 70/30 to 95/5, more preferably from 75/25 to 95/5, and even more preferably from 80/20 to 93/7. When the added amount of the modified polyester resin is too small, the hot offset resistance of the toner deteriorates and in addition, it is impossible for the toner to achieve a good combination of high temperature preservability and low temperature fixability.

The binder resin including an unmodified polyester resin and a urea-modified polyester resin preferably has a glass transition temperature (Tg) of from 45 to 65° C., and preferably from 45 to 60° C. When the glass transition temperature is too low, the heat resistance of the toner deteriorates. In contrast, when the glass transition temperature is too high, the low temperature fixability of the toner deteriorates.

Since a urea-modified polyester resin tends to be located on the surface of toner particles, the toner has a relatively good high temperature preservability compared with conventional toners including a polyester resin even when the toner has a relatively low glass transition temperature compared with the conventional toners.

Colorant

The toner for use in the image forming apparatus of the present invention includes a colorant. Suitable materials for use as the colorant include known dyes and pigments.

Specific examples of the dyes and pigments include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight of the toner.

Master batches, which are complexes of a colorant with a resin, can be used as the colorant of the toner for use in the present invention.

Specific examples of the resins for use as the binder resin of the master batches include polymers of styrene or styrene derivatives, copolymers of styrene or styrene derivatives with a vinyl monomer, polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These can be used alone or in combination.

Charge Controlling Agent

The toner for use in the image forming apparatus of the present invention preferably includes a charge controlling agent. Any known charge controlling agents can be used for the toner.

Suitable examples of the charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, etc. Among these materials, metal salts of salicylic acid and salicylic acid derivatives are preferably used. These materials can be used alone or in combination.

Specific examples of the marketed charge controlling agents include BONTRON® 03 (Nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group, etc.

Among these materials, materials capable of imparting a negative charge to the toner are preferably used.

The content of the charge controlling agent in the toner of the present invention is determined depending on the variables such as choice of binder resin, presence of additives, and dispersion method. In general, the content of the charge controlling agent is preferably from 0.1 to 10 parts by weight, and more preferably from 0.2 to 5 parts by weight, per 100 parts by weight of the binder resin included in the toner. When the content is too high, the charge quantity of the toner excessively increases, and thereby the electrostatic attraction between the developing roller and the toner increases, resulting in deterioration of fluidity and decrease of image density.

Release Agent

The toner for use in the image forming apparatus of the present invention can include a release agent. Suitable release agents include waxes having a melting point of from 50 to 120° C. When such a wax is included in the toner, the wax is dispersed in the binder resin and serves as a release agent while being present at a location between a fixing roller and the toner particles in the fixing process. Thereby the hot offset problem can be avoided without applying an oil to the fixing roller used.

Specific examples of the release agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. Further, fatty acid amides such as 1,2-hydroxylstearic acid amide, stearic acid amide and phthalic anhydride imide; and low molecular weight crystalline polymers such as acrylic homopolymers and copolymers having a long alkyl group in their side chain, e.g., poly-n-stearyl methacrylate, poly-n-laurylmethacrylate and n-stearyl acrylate-ethyl methacrylate copolymers, can also be used.

The above-mentioned charge controlling agent and release agent can be kneaded with a master batch and a binder resin. Alternatively, the charge controlling agent and the release agent can be added to an organic solvent when the toner composition liquid is prepared.

Modified Layered Inorganic Material

By including a modified layered inorganic material in the toner composition liquid, the Casson yield value of the toner composition liquid can be controlled so as to be from 1 to 100 Pa. When the Casson yield value is too low, the resultant toner particles cannot obtain the desired shape. In contrast, when the Casson yield value is too high, the productivity of the toner deteriorates.

The added amount of a modified layered inorganic material in the toner composition liquid is preferably from 0.05 to 10% by weight based on the total weight of the solid components included in the toner composition liquid. When the added amount is too small, the toner composition liquid cannot have the target Casson yield value. In contrast, when the added amount is too large, the fixability of the resultant toner deteriorates.

The modified layered inorganic material is a layered inorganic material in which at least part of interlayer ions is modified with an organic ion. For example, at least part of metal cations serving as interlayer ions is replaced with a quaternary ammonium ion. Specific examples of the modified layered inorganic material include montmorillonite and smectite, which are modified by an organic ion.

Layered inorganic materials are defined as inorganic minerals in which layers having a thickness of few micrometers are overlaid. When modifying the materials, one or more organic ions are incorporated as interlayer ions. This is called intercalation. Specific examples of the layered inorganic materials include smectite family (e.g., montmorillonite and saponite), kaolin family (e.g., kaolinite), magadiite, and kanemite.

Because of having a modified layered structure, the modified layered inorganic materials have good hydrophilicity. When an unmodified layered inorganic material is included in the toner composition liquid and the toner composition liquid is dispersed in an aqueous medium, the material is migrated into the aqueous medium, and thereby deformation of toner particles cannot be performed. When a modified layered inorganic material, which has a less hydrophilicity than unmodified layered inorganic materials, is used, the material is deformed into fine particles during the granulation process (i.e., the toner particle preparation process), and thereby the fine particles of the material are dispersed in the toner composition liquid. Therefore, a good charge controlling function of the modified layered inorganic material can be activated. In addition, since the fine particles of the modified layered inorganic material tend to present on or in a surface portion of the toner particles, a low temperature fixability can be imparted to the toner as well as the charge controlling function. As mentioned above, the added amount of a modified layered inorganic material in the toner composition liquid is preferably from 0.05 to 10% by weight based on the total weight of the solid components included in the toner composition liquid. When the added amount is too small, the toner composition liquid cannot have the target Casson yield value. In contrast, when the added amount is too large, the fixability of the resultant toner deteriorates.

The modified layered inorganic material for use in the toner of the present invention is preferably a smectite-crystal-form layered inorganic material modified by an organic cation. In addition, it is preferable to replace a divalent metal ion of the layered inorganic material with a trivalent metal ion to form a metal anion in the layered inorganic material. In this regard, the metal-anion-incorporated layered inorganic material has high hydrophilicity, and therefore it is preferable to replace at least part of the metal anion with an organic anion.

Suitable organic compounds for use in forming organic cations include quaternary alkyl ammonium salts, phosphonium salts, imidazolium salts, etc. Among these compounds, quaternary alkyl ammonium salts are preferable. Specific examples of the quaternary alkyl ammonium salts include trimethylstearyl ammonium, dimethylstearylbenzyl ammonium, dimethyloctadecyl ammonium, oleylbis(2-hydroxyethyl)methyl ammonium, etc. In addition, sulfates, sulphonates, and carboxylates, and phosphates, which have a group (or a structure) such as linear, branched or cyclic alkyl groups (C1-C44), alkenyl groups (C1-C22), alkoxyl groups (C8-C32), hydroxyalkyl groups (C2-C22), ethylene oxide structure, and propylene oxide structure, can also be used.

When at least part of interlayer ions of a layered inorganic material is modified with one or more organic ions, the modified layered inorganic material have proper hydrophobicity. By including such a modified layered inorganic material in the toner composition liquid, the toner composition liquid has a non-Newtonian viscosity, and therefore deformation of the toner particles can be performed.

Specific examples of the smectite-crystal-form layered inorganic materials include montmorillonite, bentonite, hectolite, hectorite, attapulgite, sepiolite, and mixtures of these materials. Among these materials, montmorillonite and bentonite are preferably used because the modified versions of these materials can easily adjust the viscosity of the toner composition liquid even in a small added amount without deteriorating the toner properties.

Specific examples of the marketed products of organic-cation-modified layered inorganic materials include quaternium 18 bentonite such as BENTONE 3, BENTONE 38, BENTONE 38V, (from Elementis Specialties), THIXOGE1 VP (from United Catalyst), CLAYTON 34, CLAYTON 40, and CLAYTON XL (from Southern Clay); stearalkonium bentonite such as BENTONE 27 (from Elementis Specialties), THIXOGE1 LG (from United Catalyst), CLAYTON AF and CLAYTON APA (from Southern Clay); quaternium 18/benzalkonium bentonite such as CLAYTON HT and CLAYTON PS (from Southern Clay), etc. Among these materials, CLAYTON AF and CLAYTON APA are preferably used.

Specific examples of the marketed products of organic-anion-modified layered inorganic materials include materials which are prepared by modifying DHT-4A (from Kyowa Chemical Industry Co., Ltd.) with a material having the following formula (1) (such as HITENOL 330T from Dai-ichi Kogyo Seiyaku Co., Ltd.).

$$R1(OR2)_nOSO_3M \quad (1)$$

wherein R1 represents an alkyl group having 13 carbon atoms; R2 represents an alkylene group having 2 to 6 carbon atoms; n is an integer of from 2 to 10, and M represents a monovalent metal element.

By using a modified layered inorganic material, which has proper hydrophobicity, the toner composition liquid can have a non-Newtonian viscosity, and thereby deformation of the toner particles can be performed.

In the present application, the Casson yield value is measured with a high shear viscometer. The measurement conditions are as follows.

Instrument: AR2000 (from TA Instruments)
Shear stress: 120 Pa/5 minutes
Geometry: 40 mm steel plate
Geometry gap: 1 μm
Analysis software: TA DATA ANALYSIS (from TA Instruments)

Next, the method for preparing the toner of the present invention will be explained.

The following method can be preferably used for preparing the toner of the present invention, but the toner preparation method is not limited thereto.

(1) Preparation of Toner Composition Liquid

At first, a toner composition liquid is prepared by dissolving or dispersing toner constituents (such as unmodified polyester resins, polyester prepolymers having an isocyanate group, compounds (e.g., amines) capable of reacting with the prepolymers to cause a molecular chain growth reaction and/or a crosslinking reaction of the prepolymer, colorants, release agents, and modified layered inorganic materials) in an organic solvent.

The organic solvent preferably has a boiling point of less than 100° C. so as to be easily removed after the toner particle forming process (i.e., granulation process). Specific examples of such volatile solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. In particular, aromatic solvents such as toluene and xylene, and halogenated hydrocarbons such as methylene chloride, 1,2-dichloroethane, chloroform and carbon tetrachloride are preferably used.

The weight ratio of the organic solvent to the polyester prepolymer is generally from 0/100 to 300/100, preferably from 0/100 to 100/100 and more preferably from 25/100 to 70/100.

(2) Emulsification of the Toner Composition Liquid

The toner composition liquid is then dispersed in an aqueous medium in the presence of a surfactant and a particulate resin to prepare an emulsion. Suitable materials for use as the aqueous medium include water. In addition, organic solvents which can be mixed with water can be added to water. Specific examples of such solvents include alcohols such as methanol, isopropanol, and ethylene glycol; dimethylformamide, tetrahydrofuran, cellosolves such as methyl cellosolve, lower ketones such as acetone and methyl ethyl ketone, etc.

The weight ratio of the aqueous medium to the toner composition liquid is generally from 50/100 to 2,000/100 and preferably from 100/100 to 1,000/100. When the added amount of the aqueous medium is too low, the toner composition liquid cannot be well dispersed, and thereby toner particles having a desired particle diameter cannot be prepared. Adding a large amount of aqueous medium is not economical.

When the toner composition liquid is emulsified, a dispersant such as surfactants and particulate resins are preferably included in the aqueous medium.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di)octylaminoethyle)glycin, and N-alkyl-N,N-dimethylammonium betaine.

By using a fluorine-containing surfactant as the surfactant, good effects can be produced even when the added amount is small.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl (C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and their metal salts, perfluoroalkyl(C7-C13) carboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc.

Specific examples of the marketed products of such surfactants include SARFRON® S-111, S-112 and S-113, which are manufactured by Asahi Glass Co., Ltd.; FLUORAD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surfactants having a fluoroalkyl group, which can disperse an oil phase including toner constituents in water, include primary, secondary and tertiary aliphatic amines having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, imidazolinium salts, etc. Specific examples of the marketed products thereof include SARFRON® S-121 (from Asahi Glass Co., Ltd.); FLUORAD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

Particulate resins can be added to the aqueous medium to stabilize the toner particles which are prepared in the aqueous medium. It is preferable that the added particulate resin covers the surface of toner particles at a covering ratio of from 10 to 90%. Specific examples of the particulate resins include particulate polymethyl methacrylates (having a particle diameter of about 1 μm or 3 μm), particulate polystyrenes (having a particle diameter of about 0.5 μm or 2 μm), and particulate styrene-acrylonitrile copolymers (having a particle diameter of about 1 μm). Specific examples of the marketed products of the particulate resins include PB-200H (from Kao Corp.), SGP (from Sohken Chemical & Engineering Co., Ltd.), TECHNOPOLYMER SB (from Sekisui Plastics Co., Ltd.), SGP-3G (from Sohken Chemical & Engineering Co., Ltd.), MICROPEARL (Sekisui Chemical Co., Ltd.), etc.

In addition, inorganic compounds can be used as a dispersant. Specific examples of the inorganic compounds include tricalcium phosphate, calcium carbonate, titanium oxide, colloidal silica, and hydroxyapatite can be preferably used.

Further, it is preferable to stabilize the emulsion or dispersion using a polymer protection colloid in combination with the particulate resins and inorganic dispersants.

Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

Known dispersing machines can be used for emulsifying the toner composition liquid in an aqueous medium. Suitable dispersing machines include low speed shearing dispersion machines, high speed shearing dispersion machines, friction dispersion machines, high pressure jet dispersion machines, ultrasonic dispersion machines, etc.

When high speed shearing dispersion machines are used, the revolution of the rotor is not particularly limited, but the revolution is generally from 1,000 to 30,000 rpm, and preferably from 5,000 to 20,000. The dispersion time is not particularly limited. When a batch dispersion machines are used, the dispersion time is generally from 0.1 to 5 minutes. The dispersion temperature is preferably from 0 to 150° C. and preferably from 40 to 98° C.

(3) Reaction of Polyester Prepolymer (a) with Amine (B)

At the same time when preparing the emulsion, the polyester prepolymer having an isocyanate group is reacted with an amine. The reaction is accompanied with crosslinking and/or molecular chain growth of the prepolymer. The reaction time is determined depending on the reactivity of the isocyanate group of the polyester prepolymer with the amine used, and is generally from 10 minutes to 40 hours, and preferably from 2 to 24 hours. The reaction temperature is generally from 0 to 150° C., and preferably from 40 to 98° C.

In addition, known catalysts such as dibutyltin laurate and tioctyltin layrate can be used for the reaction, if desired.

(4) Removal of Organic Solvent and Washing and Drying

After the reaction, the organic solvent is removed from the emulsion (i.e., the reaction product), followed by washing and drying of the reaction product. In order to remove the organic solvent, the emulsion is gradually heated while the emulsion is agitated so as to have a laminar flow. In this case, it is preferable to remove the solvent in a certain temperature range while strongly agitating the emulsion, so that the resultant toner particles have a spindle form. When a dispersant (such as calcium phosphate), which can be dissolved in an acid or an alkali, is used, it is preferable to dissolve the dispersant with hydrochloric acid to remove the dispersant from the toner particles, followed by washing of the toner particles. In addition, it is possible to remove such a dispersant by decomposing the dispersant using an enzyme.

(5) Addition of External Additive

Then a charge controlling agent is fixed on the thus prepared toner particles and an external additive such as particulate inorganic materials (e.g., silica and titanium oxide) is added thereto. These materials can be added by a method using a known mixer or the like.

By using such a method, a toner having a small particle diameter and a sharp particle diameter distribution can be easily prepared. By controlling the agitation during the solvent removing operation, the particle form of the toner can be easily changed from spherical forms to rugby-ball forms. In addition, the surface conditions of the toner particles can be controlled so as to have a surface of from smooth surface to rough surface like pickled plum.

The ratio (Dv/Dn) of the volume average particle diameter (Dv) to the number average particle diameter (Dn) of the toner can be controlled, for example, by adjusting the viscosities of the aqueous phase liquid and oil phase liquid, and the properties and added amount of the particulate resin. The volume average particle diameter (Dv) and the number average particle diameter (Dn) can be controlled, for example, by adjusting the properties and added amount of the particulate resin.

Figure 7A:
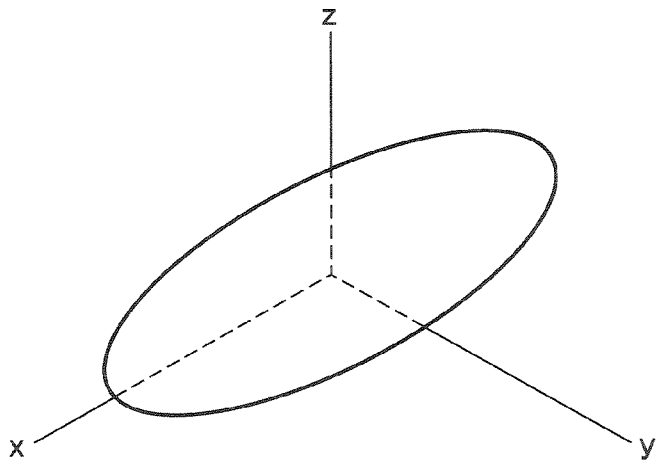
FIGS. 7A-7C are schematic views for explaining the major axis diameter r1, minor axis diameter r2 and thickness r3 of a toner particle.
Figure 7B:
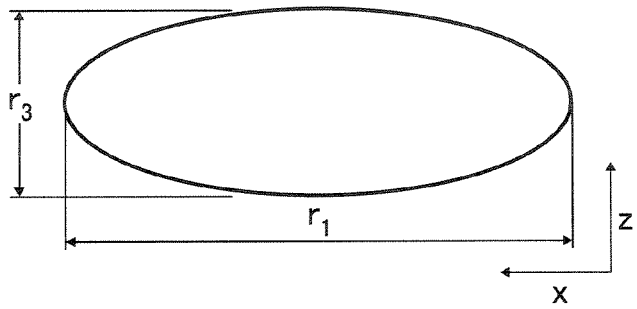
Figure 7C:
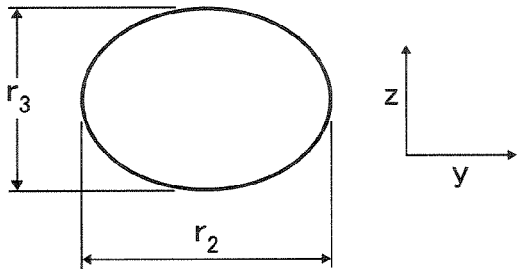

The toner for use in the present invention preferably has a form similar to the spherical form, and preferably satisfies the following relationships:

$$0.5 \leqq (r2/r1) \leqq 1.0 \text{ and } 0.7 \leqq (r3/r2) \leqq 1.0,$$

wherein r1, r2 and r3 represent the average major axis particle diameter of particles of the toner, the average minor axis particle diameter and the average thickness of particles of the toner, respectively, wherein $r3 \leqq r2 < r1$. The major axis particle diameter, the minor axis particle diameter and the thickness of a toner particle are defined as illustrated in FIGS. 7A-7C.

When the ratio (r2/r1) is too small, the toner has a form far away from the spherical form, and therefore the dot reproducibility and transfer efficiency deteriorate, resulting in deterioration of image qualities.

When the ratio (r3/r2) is too small, the toner is inferior to a spherical toner in transferability. In particular, when the ratio (r3/r2) is 1.0, the toner easily rotates on its major axis, resulting in improvement of the fluidity of the toner.

The above-mentioned size factors (i.e., r1, r2 and r3) of toner particles can be determined by observing 100 pieces of the toner particles with a color laser microscope VK-8500 (from Keyence Corp.) of 500 power magnification and then arithmetically averaging the data of each of r1, r2 and r3.

The toner particles are preferably mixed with a particulate material (i.e., an external additive) having an average primary particle diameter of from 50 to 500 nm and a bulk density of not less than 0.3 g/cm$^3$. In this case, good cleanability can be imparted to the toner. In addition, in a case of small particle toner, deterioration of developability and transferability can be prevented.

When silica is used as an external additive, silica having an average primary particle diameter of from 10 to 30 nm and a bulk density of from 0.1 to 0.2 g/cm$^3$ is preferably used.

When such a particulate material is present on the surface of the toner particles, a gap is formed between the toner particles and other materials (such as other toner particles and image forming members (e.g., image bearing members (e.g., photoreceptors and intermediate transfer media), developing members and charging members), and thereby the adhesion force of the toner to the members can be reduced. Therefore, the developability and transferability of the toner can be improved. In addition, such a particulate material serves like a roller, and thereby the photoreceptor is prevented from being abrade or damaged. In addition, even in a high stress (high pressure and/or high speed) cleaning process in which the toner particles on the photoreceptor are removed with a blade, the particulate material is hardly embedded into the toner particles. Even if particulate material is slightly embedded into the toner particles, the particulate material tends to achieve the original state. Therefore, the toner can maintain good properties for a long period of time. Further, since the particulate material is properly released from the surface of the toner particles to a moderate degree, the free particulate material tends to accumulate at the edge of the cleaning blade used and serves as a dam, thereby preventing toner particles from passing through the nip between the blade and the surface of the photoreceptor. This property of the particulate material reduces the shear force applied to the toner particles, and thereby occurrence of a filming problem in that a film of the toner is formed on the surface of the photoreceptor can be prevented. When the average primary particle diameter of the particulate material is from 50 to 500 nm, good cleanability can be imparted to the toner without deteriorating the fluidity of the toner. In addition, when a surface treated particulate material is used, the properties of the developer are hardly deteriorated even if the particulate material contaminates the carrier included in the developer. The reason therefor is not yet determined.

The average primary particle diameter of the particulate material is preferably from 50 to 500 nm and more preferably from 100 to 400 nm. When the average primary particle diameter is too small, the particulate material hardly serves like a roller. In contrast, when the average primary particle diameter is too large, the residual toner particles pass through the gap between the cleaning blade and the surface of the photoreceptor, resulting in defective cleaning. This is because the free particulate material adhered to the edge of the blade has almost the same size as that of the toner particles.

When the bulk density is too low, the scattering property and adhesion force of the toner increase. Therefore, the particulate material hardly serves like a roller and in addition the dam effect cannot be produced because a large amount of particulate material tends to be adhered to the edge of the cleaning blade.

Specific examples of the particulate material include inorganic materials such as $SiO_2$, $TiO_2$, $Al_2O_3$, MgO, CuO, ZnO, $SnO_2$, $CeO_2$, $Fe_2O_3$, BaO, CaO, $K_2O$, $Na_2O$, $ZrO_2$, CaO. $SiO_2$, $K_2O(TiO_2)n$, $Al_2O_3$, $2SiO_2$, $CaCO_3$, $MgCO_3$, $BaSO_4$, $MgSO_4$, $SrTIO_3$, etc. Among these materials, $SiO_2$, $TiO_2$ and $Al_2O_3$ are preferably used. These inorganic materials can be subjected to a hydrophobizing treatment using a compounds such as coupling agents, hexamethyldisilazane, dimethyldichlorosilane, octyltrimethoxysilane, etc.

Organic materials can also be used as the particulate material. Specific examples of such particulate organic materials include particles of thermoplastic resins and thermosetting resins, such as vinyl resins, polyurethane resins, epoxy resins, polyester resins, polyamide resins, polyimide resins, silicone resins, phenolic resins, melamine resins, urea resins, aniline resins, ionomer resins, polycarbonate resins, etc. These materials can be used alone or in combination. Among these organic materials, vinyl resins, polyurethane resins, epoxy resins, polyester resins and mixtures of the resins are preferably used because aqueous dispersions of these resins can be easily prepared.

Vinyl resins are defined as homopolymers or copolymers of vinyl monomers. Specific examples of the vinyl resins include styrene-(meth)acrylate copolymers, styrene-butadiene copolymers, (meth)acrylic acid-acrylate copolymers, styrene-acrylonitrile copolymers, styrene-maleic anhydride copolymers, styrene-(meth)acrylic acid copolymers, etc.

In the present application, the bulk density of a particulate material is determined by the following method.

(1) At first, a particulate material is gradually fed into a cylindrical container having a volume of 100 $cm^3$;

(2) a nonmagnetic flat blade is slid once along the upper surface of the cylindrical container to remove the portion of the particulate material projected from the container;

(3) the weight of the carrier in the container is measured to determine the bulk density ($g/cm^3$) of the particulate material.

The bulk density can be determined by the following equation.

$$\text{Bulk Density}(g/cm^3)=\text{Weight}(g/100ml)/100.$$

The method for adhering a particulate material on the surface of toner particles is as follows.

(1) A dry method in which a particulate material is mixed with toner particles using a known mixer (mechanical mixing methods).

(2) A wet method in which a particulate material and toner particles are dispersed in a liquid including a surfactant to adhere the particulate material to the surface of the toner particles, followed by drying.

The particle diameter and particle diameter distribution of the materials dispersed in the toner composition liquid are determined using an instrument MICROTRACK UPA-150 and an analysis software MICROTRACK PARTICLE SIZE ANALYZER Ver. 10.1.2-016EE, both of which are from Nikkiso Co., Ltd. Specifically, the measuring method is as follows.

(1) In a 30-ml glass container, a toner composition liquid is diluted with the solvent used for the toner composition liquid to prepare a diluted toner composition liquid having a solid content of 10% by weight;

(2) the diluted toner composition liquid is subjected to a dispersion treatment for 2 minutes using a supersonic dispersing machine W-113MK-II from Honda Electronics Co., Ltd.;

(3) the background level of the instrument is measured using the solvent used for the toner composition liquid;

(4) the diluted toner composition liquid is dropped into the solvent until the sample loading value falls in a range of from 1 to 10; and (5) the particle diameter and particle diameter distribution of the toner composition liquid are measured with the instrument and software mentioned above.

In this regard, it is important to control the dropping condition so that the sample loading value falls in a range of from 1 to 10. Measurement conditions are as follows.

Particle diameter distribution: Volume particle diameter distribution

Particle ranges: Standard

Number of channels: 44

Measurement time: 60 seconds

Number of measurement: 1 time

Transparency of particle: Transparent

Refractive index of particle: 1.5

Shape of particle: Non-spherical

Density of toner: 1 $g/cm^3$

The information on the refractive index of the solvent used is obtained from "Guideline for measurement conditions" issued by Nikkiso Co., Ltd.

Next, the image forming apparatus of the present invention will be explained by reference to drawings.

Figure 4:
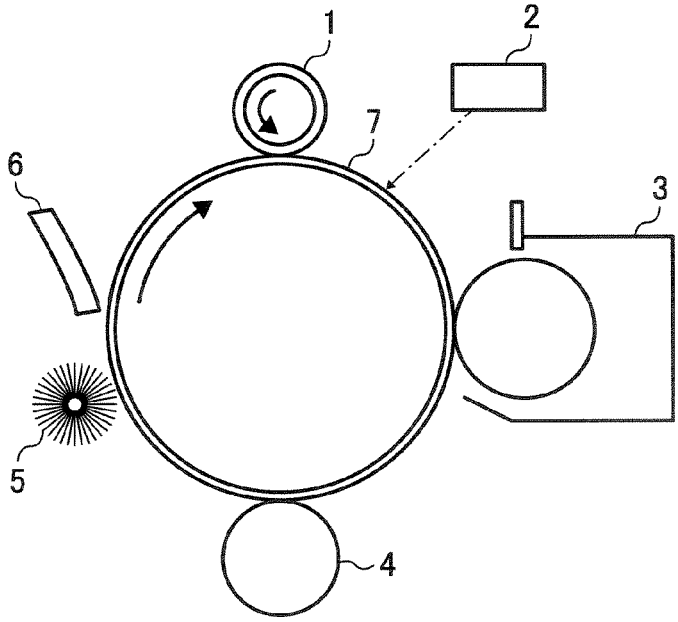
FIG. 4 is a schematic view illustrating an example of the image forming apparatus of the present invention.

FIG. 4 is a schematic view illustrating an example of the image forming apparatus of the present invention.

When an image forming order is made, voltages or currents are timely applied to the image bearing member 7, charging device 1, developing device 3, transfer device 4, and cleaning device (the auxiliary cleaner 5 and cleaner 6) so that the devices start their operations.

The image bearing member 7 is negatively charged so as to have a predetermined potential (e.g., −900V). The light irradiating device 2 irradiates the charged image bearing member 7 with imagewise light to form an electrostatic latent image on the image bearing member in which the lighted portion has a potential of −150V, for example.

The developing device 3 develops the electrostatic latent image with a developer including the toner of the present invention to form a toner image on the image bearing member 7. In this regard, a developing bias of, for example, −600V is applied.

The transfer device 4 transfers the toner image formed on the image bearing member 7 to a sheet of a receiving material, which has been timely fed to the transfer device 4 from a paper feeding device. Thus, the toner image is transferred to a predetermined position of the sheet. In this regard, a transfer bias of, for example, +10 μA is applied.

Similarly to the image forming apparatus illustrated in FIG. 1, the receiving material sheet bearing a toner image thereon is fed to a fixing device to fix the toner image on the receiving material sheet, followed by discharge of the copy (or print) from the image forming apparatus.

Specific examples of the charging device 1 include short-range chargers, contact chargers and corona chargers, which apply a DC voltage or a DC voltage overlapped with an AC voltage.

Specific examples of the light irradiating device 2 include devices using a laser diode (LD), a light emitting diode (LED), a xenon lamp or the like.

Specific examples of the developing device 3 include one-component developing devices using a one-component developer, and two-component developing devices using a two-component developer.

Specific examples of the transfer device 4 include devices including a transfer belt, a transfer charger, a transfer roller or the like.

Specific examples of the auxiliary cleaner 5 include fur brushes, elastic rollers, rollers covered with a tube, devices having a non-woven cloth or the like. Plural auxiliary cleaners may be provided or it is possible to use no auxiliary cleaner.

Specific examples of the cleaner 6 include cleaning blades which are typically made of a material such as polyurethane rubbers, silicone rubbers, nitrile rubbers and chloroprene rubbers. Referring to FIG. 4, the blade is set so as to counter the rotated image bearing member 7. However, the configuration of the blade is not limited thereto, and the blade may be set so as to trail the image bearing member 7. The conditions of the blade are preferably as follows.

Elasticity: 20 to 80%

Thickness: 1 to 6 mm

Contact angle: 15 to 45° (counter setting)

90 to 175° (trailing setting)

Figure 8:
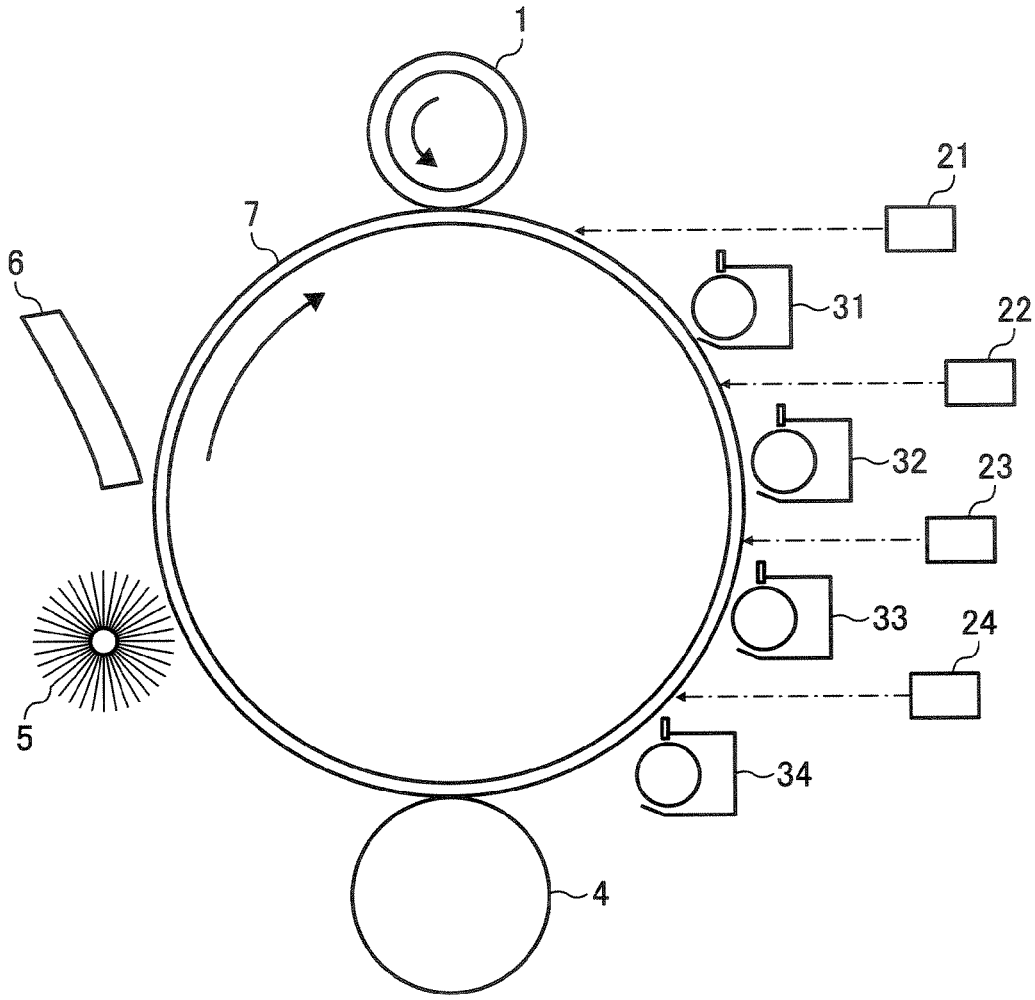
FIG. 8 is a schematic view illustrating another example of the image forming apparatus of the present invention, which is of a revolver type.

As illustrated in FIG. 8, the image forming apparatus of the present invention can have a configuration such that plural developing devices 31-34 are set around one image bearing member 7. In FIG. 8, numerals 21-24 denote light irradiating devices for forming electrostatic latent images corresponding to the color images (for example, yellow, magenta, cyan and black color images).

In this image forming apparatus, if color toner particles remaining on the image bearing member 7 are not well removed, the residual color toner particles will be mixed with the following different color image formed on the image bearing member 7. By using the toner of the present invention for the image forming apparatus, occurrence of such a color mixing problem can be prevented because toner particles remaining on the image bearing member can be well removed by the cleaning device.

Figure 9:
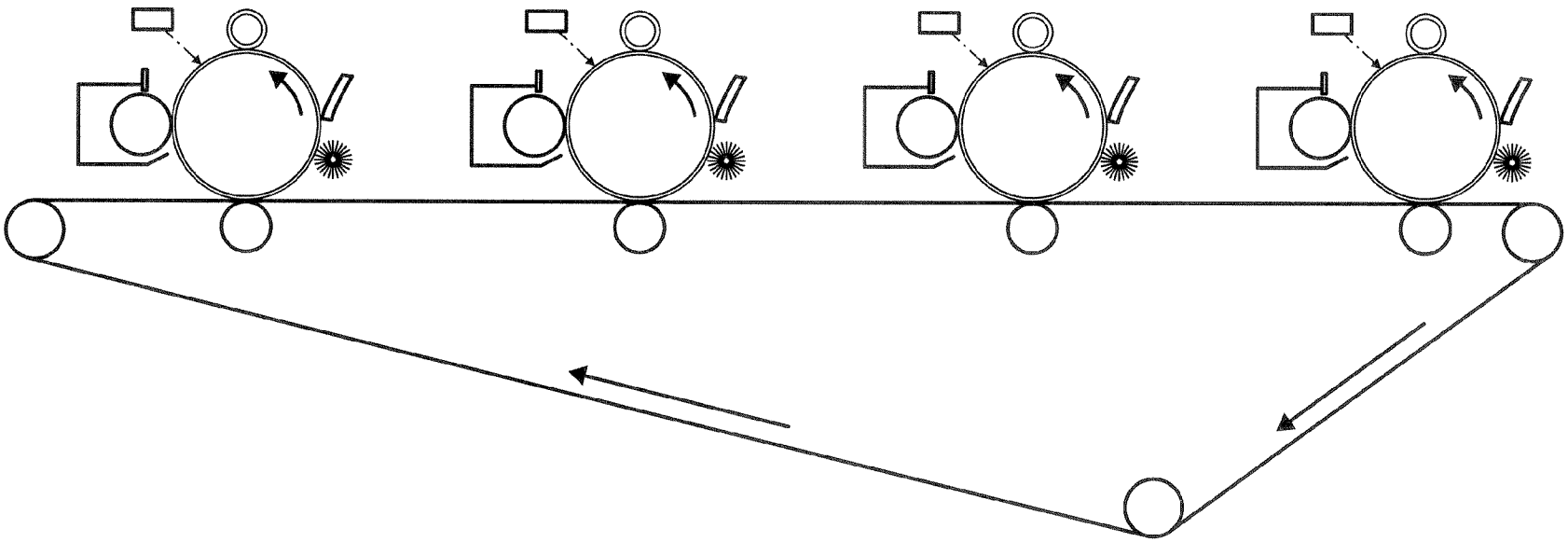
FIG. 9 is a schematic view illustrating another example of the image forming apparatus of the present invention, which is of a tandem type.

As illustrated in FIG. 9, the image forming apparatus of the present invention can have a configuration such that plural sets of image forming sections are provided, each of which includes at least an image bearing member, a charging device, a developing device, a transfer device and a cleaning device. The image forming apparatus further includes a belt for feeding a sheet of the receiving material on which the toner images formed on the image bearing members are transferred.

It is possible in this image forming apparatus that a color toner image transferred to a receiving material sheet is retransferred to the other image bearing members when other color toner images formed thereon are transferred to the receiving material sheet. If the different color toner particles present on the other image bearing members are not well removed, the residual color toner particles are mixed with the other color toners, resulting in deterioration of color reproducibility of images. By using the toner of the present invention for the image forming apparatus, occurrence of the color mixing problem can be prevented because toner particles remaining on the image bearing member can be well removed by the cleaning device.

Figure 10:
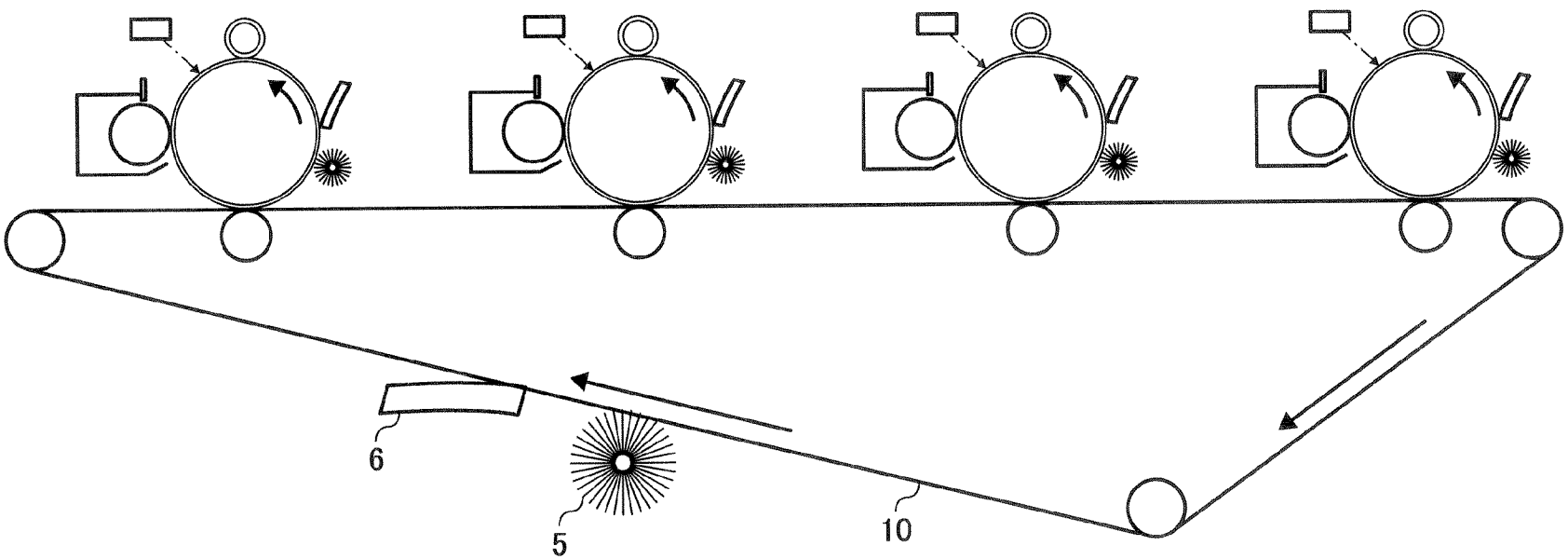
FIG. 10 is a schematic view illustrating another example of the image forming apparatus of the present invention, which uses an intermediate transfer medium.

As illustrated in FIG. 10, the image forming apparatus of the present invention can have a configuration such that plural sets of image forming sections and an intermediate transfer medium 10 are provided. As illustrated in FIG. 10, it is preferable to provide a cleaning device (such as the cleaner 6 and auxiliary cleaner 5) for the intermediate transfer medium 10.

Referring to FIG. 10, color toner images formed on the image bearing members are transferred onto the intermediate transfer medium 10 so as to be overlaid thereon. The overlaid color toner images are transferred onto a sheet of the receiving material at the same time.

In the image forming apparatus illustrated in FIG. 9, which uses a direct image transfer method, a problem in that the belt is soiled with toner particles (for example, toner particles dropped from the developing device), and the toner particles are adhered to the backside of a receiving material sheet tends to occur.

Similarly, in the image forming apparatus illustrated in FIG. 10, which uses an intermediate transfer method, a problem in that the intermediate transfer medium is soiled with toner particles (for example, toner particles dropped from the developing device), and the toner particles are adhered to the front side (i.e., image side) of a receiving material sheet tends to occur. In addition, it is possible that when the color toner images overlaid on the intermediate transfer medium are transferred onto a receiving material sheet, toner particles remain on the surface of the intermediate transfer medium without being transferred.

Therefore, it is preferable to clean the surfaces of the belts (FIG. 9) and the intermediate transfer medium (FIG. 10) with a cleaning device (such as combinations of a cleaning blade and a cleaning brush). When a toner prepared by a granulation method is used for the image forming apparatuses illustrated in FIGS. 9 and 10, the residual toner on the belt and intermediate transfer medium cannot be well removed therefrom with a blade, resulting in occurrence of the soiling problems mentioned above. By using the toner of the present invention, occurrence of the soiling problems can be prevented.

If toner particles remain on the intermediate transfer medium without being transferred, the toner particles are mixed with the following color images, resulting in formation of abnormal images. By using the toner of the present invention, occurrence of the problem can be prevented.

Figure 11:
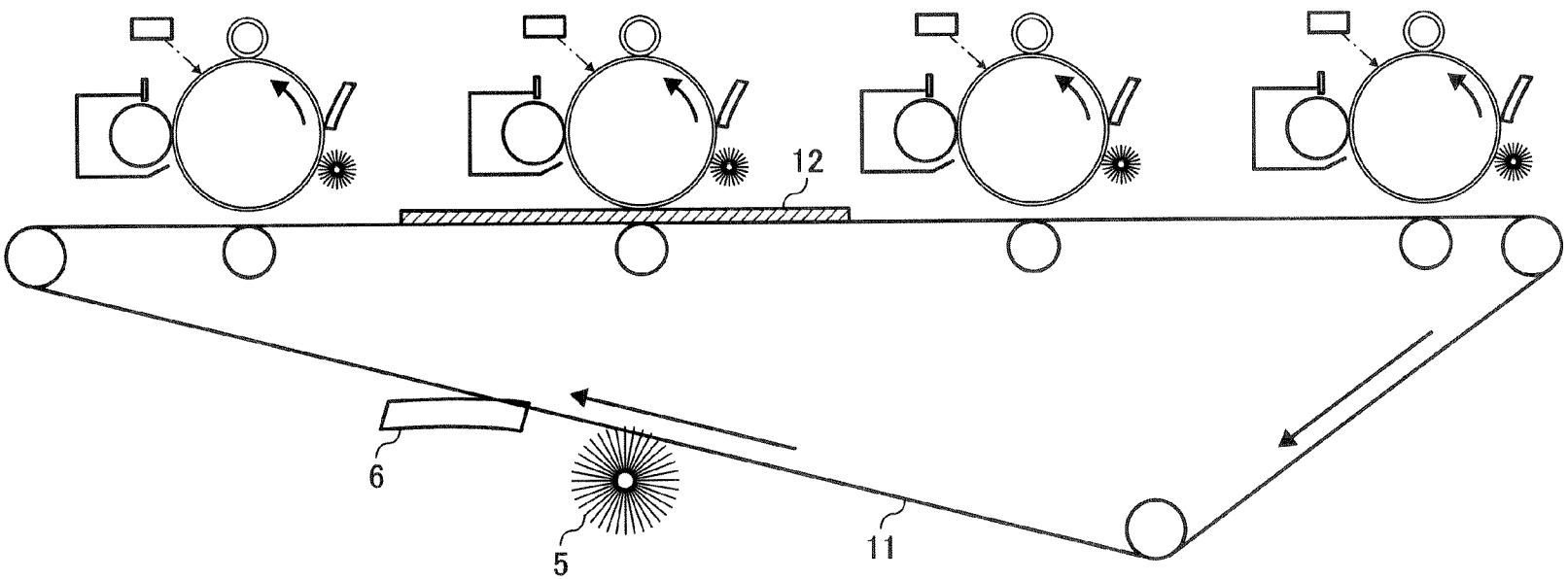
FIG. 11 is a schematic view illustrating another example of the image forming apparatus of the present invention, which uses a transfer belt.

The image forming apparatus illustrated in FIG. 11 is the same as the image forming apparatus illustrated in FIG. 9 except that a cleaning device including a combination of the cleaner 6 and the auxiliary cleaner 5 is provided to clean the surface of the transfer belt 11. If toner particles remain on the transfer belt 11 without being removed by the cleaning device, the toner particles are transferred to the backside of a receiving material sheet, resulting in formation of the backside soiling problem. By using the toner of the present invention, occurrence of the problem can be prevented.

The image bearing member 7 of the image forming apparatus of the present invention is preferably a photoreceptor having a filler-reinforced protective layer as the outermost layer. Such a photoreceptor has a long life.

A filler is included in the protective layer to improve the abrasion resistance of the photoreceptor. Specific examples of the filler include organic fillers such as particles of fluorine-containing resins (e.g., polytetrafluoroethylene), silicone resins, and amorphous carbons; and inorganic fillers such as powders of metals (e.g., copper, tin, aluminum and indium), powders of metal oxides (e.g., tin oxide, zinc oxide, titanium oxide, indium oxide, antimony oxide, bismuth oxide, tin oxide doped with antimony, and indium oxide doped with tin), powders of potassium titanate, etc. These inorganic fillers can be used alone or in combination.

The protective layer can be formed by coating a coating liquid which is prepared by dispersing one or more of the fillers mentioned above in a protective layer coating liquid using a proper dispersing machine. The average particle diameter of the filler included in the protective layer is preferably not greater than 0.5 μm, and more preferably not greater than 0.2 μm not to deteriorate the transparency of the protective layer. The protective layer can further include a plasticizer and/or a leveling agent.

The image bearing member is preferably a photoreceptor including a crosslinked charge transport material. Such a photoreceptor has a long life.

The image bearing member is preferably a photoreceptor including a crosslinked protective layer. A crosslinked protective layer having a three dimensional network can be formed, for example, by crosslinking a reactive monomer having plural crosslinkable functional groups in the molecule thereof upon application of heat or light energy. The thus prepared polymer having a three dimensional network serves as a binder resin and has good abrasion resistance. It is preferable to use a reactive monomer having a charge transport function for all the monomers or part of the monomers, to impart a good combination of electrical stability, durability and life to the resultant photoreceptor. The thus prepared protective layer has a good combination of charge transportability and abrasion resistance.

Examples of the reactive monomers having a charge transportability are as follows.

(1) Compounds including both a charge transport group and a silicon atom having a hydrolyzable substituent in their molecules.

(2) Compounds including both a charge transport group and a silicon atom having a hydroxyl group in their molecules.

(3) Compounds including both a charge transport group and a silicon atom having a carboxyl group in their molecules.

(4) Compounds including both a charge transport group and a silicon atom having an epoxy group in their molecules.

(5) Compounds including both a charge transport group and a silicon atom having an isocyanate group in their molecules.

These compounds can be used alone or in combination.

Reactive monomers having a triaryl amine structure are preferably used as the monomer having a charge transportability because the resultant protective layer has good electrical/chemical stability and high carrier mobility.

In addition, known monofunctional monomers, difunctional monomers, and polymerizable oligomers can be used in combination with the monomers having a charge transportability, to adjust the viscosity of the coating liquid, to perform stress relaxation on the resultant crosslinked layer and to reduce the surface energy and friction coefficient of the resultant crosslinked layer.

When polymerizing and crosslinking monomers, heat and/or light are applied thereto. When polymerization is performed only by heat, a polymerization initiator is preferably used to effectively perform the polymerization reaction at a low temperature.

When polymerization is performed by light, ultraviolet light is preferably used. Since it is seldom that the polymerization reaction is performed only by light, a light polymerization initiator is preferably used. Suitable polymerization initiators include compounds which absorb ultraviolet light having a wavelength of not greater than 400 nm to form activated species such as radicals and ions.

It is possible to use both a heat polymerization initiator and a light polymerization initiator.

The thus crosslinked protective layer having a three dimensional network has a good abrasion resistance but has a drawback in that when a thick protective layer is crosslinked, the volume thereof is largely reduced, and thereby the resultant protective layer is cracked. In order to prevent such a crack problem, it is preferable to form a double-layer protective layer in which a relatively thin upper protective layer having a three dimensional network is formed on a lower protective layer including a low molecular weight charge transport material in a binder resin.

The image bearing member 7 of the present invention is preferably a photoreceptor including amorphous silicon as a photosensitive material. In this case, the photoreceptor has a long life.

The amorphous silicon photoreceptor for use in the image forming apparatus is prepared by heating an electroconductive substrate to a temperature of from 50 to 400° C., and forming an amorphous silicon layer thereon by a method such as vacuum evaporation methods, sputtering methods, ion plating methods, heat chemical vapor deposition methods, light chemical vapor deposition methods, and plasma chemical vapor deposition methods. Among these film forming methods, plasma chemical vapor deposition methods in which a raw material gas is decomposed by glow discharge using DC, radio frequency wave or microwave to deposit amorphous silicon on the substrate are preferably used.

Examples of the layer structure of the amorphous silicon photoreceptor for use in the image forming apparatus of the present invention are illustrated in FIGS. 12A-12D.

Figure 12A:
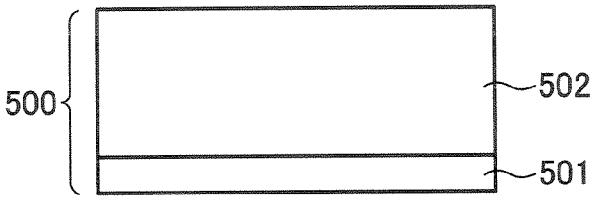
FIGS. 12A-12D illustrate the structures of amorphous silicon photoreceptors for use in the image forming apparatus of the present invention.

Referring to FIG. 12A, a photoreceptor 500 includes a substrate 501 and a photosensitive layer 502 which is located on the substrate and which includes amorphous silicon (a-Si:H,X).

Figure 12B:
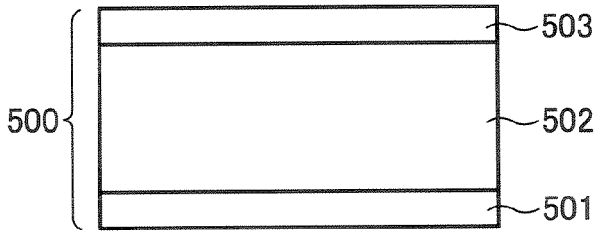

Referring to FIG. 12B, a photoreceptor 500 includes a substrate 501, a photosensitive layer 502 which is located on the substrate 501 and which includes amorphous silicon (a-Si:H,X), and an outermost layer 503 including amorphous silicon.

Figure 12C:
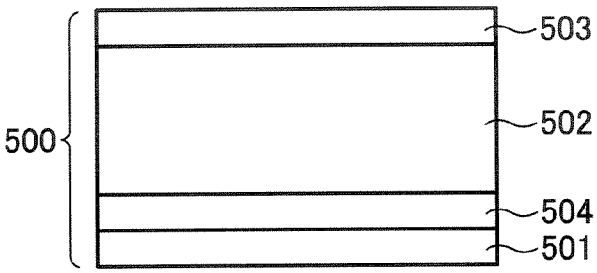

Referring to FIG. 12C, a photoreceptor 500 includes a substrate 501, a photosensitive layer 502 which is located on the substrate 501 and which includes amorphous silicon (a-Si:H,X), an outermost layer 503 including amorphous silicon, and a charge injection preventing layer 504 which is located between the substrate 501 and the photosensitive layer 502 and which includes amorphous silicon.

Figure 12D:
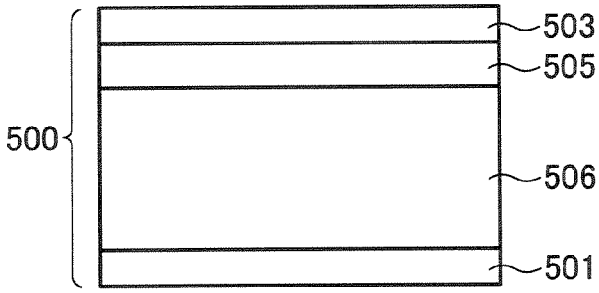

Referring to FIG. 12D, a photoreceptor 500 includes the substrate 501, a photosensitive layer, which includes a charge generation layer 505 including amorphous silicon (a-Si:H,X) and a charge transport layer 506 including amorphous silicon (a-Si:H,X), and the outermost layer 503.

The substrate 501 may be electroconductive or insulating. Specific examples of the electroconductive substrate include sheets (plates) and cylinders made of a metal (e.g., Al, Cr, Mo, Au, In, Nb, Te, Ti, Pt, Pd and Fe), and a metal alloy of these metals (e.g., stainless steel). In addition, insulating materials such as sheets and films made of a resin (e.g., polyester, polyethylene, polycarbonate, cellulose acetate, polypropylene, polyvinylchloride, polystyrene, and polyamide), and cylinders of glass and ceramics can also be used. When insulating materials are used, the surface thereof, on which a photosensitive layer is to be formed, is subjected to an electroconductive treatment.

The substrate has a shape of cylinder, plate and endless belt, and the surface thereof may be smooth or rough. The thickness is properly determined so that the resultant photoreceptor can be used for the image forming apparatus of the present invention without causing problems. When the substrate is required to have a flexibility, the thickness is reduced as much as possible in a proper thickness range. In general, the thickness of the substrate is not less than 10 μm in view of productivity, handleability and mechanical strength.

As illustrated in FIG. 12C, the charge injection preventing layer is preferably formed between the substrate and the photosensitive layer to prevent injection of charges from the substrate. Namely, when the surface of the photoreceptor is charged so as to have a predetermined potential with a polarity, the charge injection preventing layer prevents injection of charges from the substrate. In this regard, when the surface of the photoreceptor is charged so as to have a predetermined potential with the opposite polarity, the charge injection preventing layer does not prevent injection of charges from the substrate. Namely, the charge injection preventing layer has a polarity dependence. In order to impart such a function to the charge injection preventing layer, an atom capable of controlling conductivity is included in a relatively large amount compared to that in the photosensitive layer. The thickness of the charge injection preventing layer is preferably from 0.1 to 5 μm, more preferably from 0.3 to 4 μm, and even more preferably from 0.5 to 3 μm in view of effects and costs.

The photosensitive layer is formed on the substrate optionally with the charge injection preventing layer therebetween. The thickness of the photosensitive layer is determined in view of performance and costs, and is generally from 1 to 100 μm, preferably from 20 to 50 μm and more preferably from 23 to 45 μm.

As illustrated in FIG. 12D, the photosensitive layer can include a charge transport layer and a charge generation layer.

The charge generation layer has a function of generating charges when the photoreceptor is exposed to light. The charge generation layer includes at least a silicon atom, and include substantially no carbon atom. If desired, the charge generation layer includes amorphous silicon including a hydrogen atom (i.e., a-Si:H) so as to have good charge generation property and charge transport property. The thickness of the charge generation layer is determined in view of performance and costs, and is generally from 0.5 to 15 μm, preferably from 1 to 10 μm and more preferably from 1 to 5 μm.

The charge transport layer has a function of transporting the charge generated by the charge generation layer. The charge transport layer includes at least a silicon atom, a carbon atom and a fluorine atom so as to have good charge maintenance property and charge transport property. If desired, the charge transport layer further includes an oxygen atom and a hydrogen atom (i.e., a-SiC(H,F,O)). The charge transport layer of the photoreceptor for use in the present invention preferably includes an oxygen atom. The thickness of the charge transport layer is determined in view of performance and costs, and is generally from 5 to 50 μm, preferably from 10 to 40 μm and more preferably from 20 to 30 μm.

The amorphous silicon photoreceptor can have a protective layer as the outermost layer as illustrated in FIGS. 10B-10D. The protective layer includes amorphous silicon and is formed to improve the properties of the photoreceptor such as moisture resistance, repeated usage properties, electric resistance, environmental stability and durability. The thickness of the protective layer is generally from 0.01 to 3 μm, preferably from 0.05 to 2 μm and more preferably from 0.1 to 1 μm. When the protective layer is too thin, the abrasion resistance of the photoreceptor deteriorates. In contrast, when the protective layer is too thick, the residual potential (i.e., the potential of a lighted portion of the photoreceptor) increases.

Figure 13:
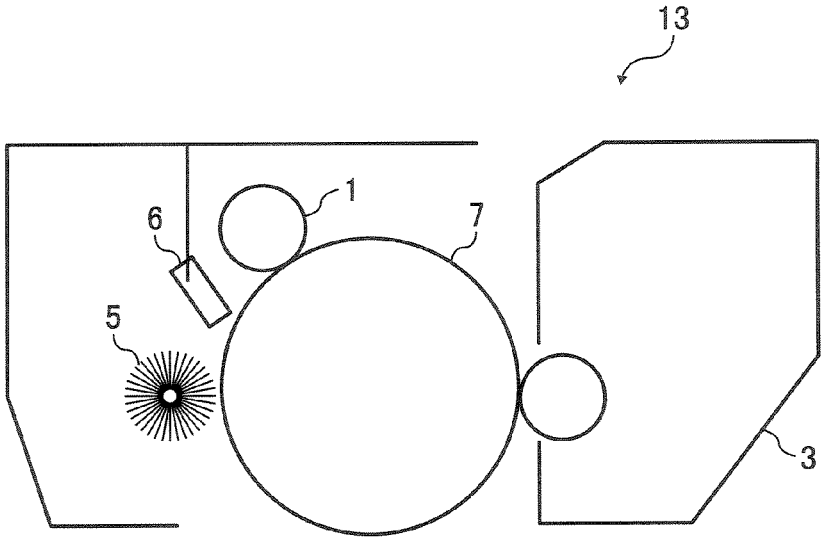
FIG. 13 is a schematic view illustrating an example of the process cartridge of the present invention.

In the image forming apparatus of the present invention can have a process cartridge which includes at least the image bearing member and at least one of the charging device, developing device, and cleaning device (cleaner and/or auxiliary cleaner) and which can be detachably attached to the image forming apparatus as a unit. By using such a process cartridge, the user maintenance of the image forming apparatus can be easily performed. An example of the process cartridge is illustrated in FIG. 13. Referring to FIG. 13, a process cartridge 13 includes the image bearing member 7, charging device 1, developing device 3 and cleaning device (i.e., auxiliary cleaner 5 and cleaner 6).

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Unmodified Polyester Resin

The following components were contained in a reaction vessel equipped with a condenser, a stirrer and a nitrogen feed pipe to perform a polycondensation reaction for 8 hours at 230° C. under normal pressure.

| | |
|---|---|
| Ethylene oxide (2 mole) adduct of bisphenol A | 229 parts |
| Propylene oxide (3 mole) adduct of bisphenol A | 529 parts |
| Terephthalic acid | 208 parts |
| Adipic acid | 46 parts |
| Dibutyltin oxide | 2 parts |

Then the reaction was further continued for 5 hours under a reduced pressure of from 10 to 15 mmHg (1332 to 1998 Pa).

Further, 44 parts of trimellitic anhydride was added to the vessel to be reacted with the reaction product for 2 hours at 180° C. under normal pressure. Thus, an unmodified polyester resin was prepared. It was confirmed that the unmodified polyester resin has a number average molecular weight of 2500, a weight average molecular weight of 6700, a glass transition temperature (Tg) of 43° C. and an acid value of 25 mgKOH/g.

(Preparation of Master Batch)

The following components were mixed using a HENSCHEL MIXER mixer from Mitsui Mining Co., Ltd.

| | |
|---|---|
| Water | 1200 parts |
| Carbon black (PRINTEX 35 from Degussa A.G. having DBP oil absorption of 42 ml/100 g and pH of 9.5) | 540 parts |
| Unmodified polyester resin | 1200 parts |

The mixture was kneaded for 30 minutes at 150° C. using a two roll mill. Then the kneaded mixture was cooled by rolling, followed by pulverization using a pulverizer (from Hosokawa Micron Corp. Thus, a master batch was prepared.

(Preparation of Wax Dispersion)

In a reaction vessel equipped with a stirrer and a thermometer, 378 parts of the unmodified polyester resin, 110 parts of a carnauba wax, 22 parts of a charge controlling agent (a metal complex of salicylic acid, E-84, from Orient Chemical Industries Co., Ltd.), and 947 parts of ethyl acetate were mixed and the mixture was heated to 80° C. while agitated. After the mixture was heated at 80° C. for 5 hours, the mixture was cooled to 30° C. over 1 hour. Then 500 parts of the master batch and 500 parts of ethyl acetate were added to the vessel, and the mixture was agitated for 1 hour to prepare a raw material dispersion.

Then 1324 parts of the raw material dispersion was subjected to a dispersing treatment using a bead mill (ULTRAVISCOMILL from Aimex Co., Ltd.). The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Thus, a wax dispersion in which the carbon black and carnauba wax are dispersed was prepared.

(Preparation of Toner Composition Liquid)

Then 1324 parts of a 65% ethyl acetate solution of the unmodified polyester resin prepared above was added to the wax dispersion. The mixture was subjected to the dispersion treatment using the bead mill. The dispersion conditions are the same as those mentioned above except that the dispersion operation was performed once (i.e., one pass).

Then 200 parts of the thus prepared dispersion was mixed with 3 parts of a modified layered montmorillonite (CLAYTON APA from Southern Clay Product), in which at least a part of interlayer ions is modified with a quaternary ammonium salt having a benzyl group. The mixture was agitated for 30 minutes with a TK HOMODISPER from Tokushu Kika Kogyo Co., Ltd. Thus, a toner composition liquid was prepared.

The viscosity of the toner composition liquid was measured by a rheometer (PARALLEL PLATE TYPE RHEOMETER AR2000 from DA Instrument Japan). The measurement conditions were as follows.

Gap between the parallel plates: 30 μm measurement temperature: 25° C.

After a shearing force was applied to the toner composition liquid for 30 seconds at a shearing speed of 30,000 $sec^{-1}$, the viscosity (i.e., viscosity A) of the liquid was determined under a condition in that the shearing speed is changed from 0 $sec^{-1}$ to 70 $sec^{-1}$ over 20 seconds. In addition, the viscosity (i.e., viscosity B) of the liquid was also determined under a condition in that a shearing force is applied thereto for 30 minutes at a shearing speed of 30,000 $sec^{-1}$.

(Synthesis of Intermediate Polyester)

The following components were contained in a reaction vessel equipped with a condenser, a stirrer, and a nitrogen feed pipe, and reacted for 8 hours at 230° C. under normal pressure.

| | |
|---|---|
| Ethylene oxide (2 mole) adduct of bisphenol A | 682 parts |
| Propylene oxide (2 mole) adduct of bisphenol A | 81 parts |
| Terephthalic acid | 283 parts |
| Trimellitic anhydride | 22 parts |
| Dibutyltin oxide | 2 parts |

Then the reaction was further continued for 5 hours under a reduced pressure of from 10 to 15 mmHg (1332 to 1998 Pa).

Thus, an intermediate polyester was prepared. It was confirmed that the intermediate polyester has a number average molecular weight of 2,100, a weight average molecular weight of 9,500, a glass transition temperature of 55° C., an acid value of 0.5 mgKOH/g and a hydroxyl value of 51 mgKOH/g.

(Preparation of Prepolymer)

Next, the following components were contained in a reaction vessel equipped with a condenser, a stirrer, and a nitrogen feed pipe, and reacted for 5 hours at 100° C.

| | |
|---|---|
| Intermediate polyester | 410 parts |
| Isophorone diisocyanate | 89 parts |
| Ethyl acetate | 500 parts |

Thus, a prepolymer was prepared. The prepolymer included isocyanate groups in an amount of 1.53% by weight.

(Synthesis of Amine Compound)

In a reaction vessel equipped with a stirrer and a thermometer, 170 parts of isophorone diamine and 75 parts of methyl ethyl ketone were mixed and reacted for 5 hours at 50° C. to prepare a ketimine compound. The ketimine compound has an amine value of 418 mgKOH/g.

(Preparation of Oil Phase Liquid)

In a reaction vessel, 749 parts of the toner composition liquid, 115 parts of the prepolymer and 2.9 parts of the ketimine compound were mixed for 1 minute using a TK HOMOMIXER which was rotated at a revolution of 5,000 rpm. Thus, an oil phase liquid was prepared.

(Preparation of Particulate Resin Dispersion)

In a reaction vessel equipped with a stirrer and a thermometer, 683 parts of water, 11 parts of a sodium salt of sulfate of an ethylene oxide adduct of methacrylic acid (ELEMINOL RS-30 from Sanyo Chemical Industries Ltd.), 83 parts of styrene, 83 parts of methacrylic acid, 110 parts of butyl acrylate, and 1 part of ammonium persulfate were mixed. The mixture was agitated for 15 minutes while the stirrer was rotated at a revolution of 400 rpm. As a result, a milky emulsion was prepared. Then the emulsion was heated to 75° C. to react the monomers for 5 hours.

Further, 30 parts of a 1% aqueous solution of ammonium persulfate was added thereto, and the mixture was aged for 5 hours at 75° C. Thus, an aqueous particulate resin dispersion was prepared.

(Preparation of Dispersion Slurry)

In a reaction vessel equipped with a stirrer, 990 parts of water, 83 parts of the particulate resin dispersion prepared above, 37 parts of an aqueous solution of a sodium salt of dodecyldiphenyletherdisulfonic acid (ELEMINOL MON-7 from Sanyo Chemical Industries Ltd., solid content of 48.5%), 135 parts of a 1% by weight aqueous solution of a carboxymethyl cellulose sodium salt (CELLOGEN BS-H-3 from Dai-ichi Kogyo Seiyaku Co., Ltd., serving a polymer dispersant), and 90 parts of ethyl acetate were mixed while agitated. Thus, an aqueous medium was prepared.

Next, 867 parts of the oil phase liquid was added to 1,200 parts of the aqueous medium, and the mixture was agitated for 20 minutes using a TK HOMOMIXER which was rotated at a revolution of 13,000 rpm. Thus, a dispersion (an emulsion slurry) was prepared.

Further, the emulsion slurry was fed to a reaction vessel equipped with a stirrer and a thermometer and heated for 8 hours at 30° C. to remove the solvent. The dispersion was further aged for 4 hours at 45° C. Thus, a dispersion slurry was prepared.

(Preparation of Toner)

One hundred (100) parts of the dispersion slurry was filtered under a reduced pressure.

Then the wet cake was mixed with 100 parts of ion-exchange water and the mixture was agitated for 10 minutes with a TK HOMOMIXER at a revolution of 12,000 rpm, followed by filtering. Thus, a wet cake (a) was prepared.

The thus prepared wet cake (a) was mixed with 100 parts of a 10% hydrochloric acid so as to have a ph of 2.8, and the mixture was agitated for 10 minutes with TK HOMOMIXER at a revolution of 12,000 rpm, followed by filtering. Thus, a wet cake (b) was prepared.

Then the wet cake (b) was mixed with 300 parts of ion-exchange water and the mixture was agitated for 10 minutes with TK HOMOMIXER at a revolution of 12,000 rpm, followed by filtering. This operation was repeated twice. Thus, a final wet cake was prepared.

The final wet cake was dried for 48 hours at 45° C. using a circulating air drier, followed by sieving with a screen having openings of 75 μm.

Thus, black toner particles were prepared.

One hundred (100) parts of the thus prepared toner particles was mixed with 1.0 part of a hydrophobized silica and 0.5 parts of a hydrophobized titanium oxide using a HENSCHEL MIXER mixer (from Mitsui Mining Co., Ltd.). Thus, a toner of Example 1 was prepared. The properties of the toner are shown in Table 1.

Example 2

The procedure for preparation of the toner in Example 1 was repeated except that the added amount of the modified layered inorganic material (CLAYTON APA) was changed from 3 parts to 0.1 parts. Thus, a toner of Example 2 was prepared. The properties of the toner are shown in Table 1.

Example 3

The procedure for preparation of the toner in Example 1 was repeated except that the modified layered inorganic material (CLAYTON APA) was changed to another layered montmorillonite (CLAYTON HY from Southern Clay Product), in which at least a part of the interlayer ions is modified by an ammonium salt having polyoxyethylene group. Thus, a toner of Example 3 was prepared. The properties of the toner are shown in Table 1.

Example 4

The procedure for preparation of the toner in Example 1 was repeated except that the added amount of the modified layered inorganic material (CLAYTON APA) was changed from 3 parts to 1.4 parts. Thus, a toner of Example 4 was prepared. The properties of the toner are shown in Table 1.

Example 5

The procedure for preparation of the toner in Example 1 was repeated except that the added amount of the modified layered inorganic material (CLAYTON APA) was changed from 3 parts to 6 parts. Thus, a toner of Example 5 was prepared. The properties of the toner are shown in Table 1.

Comparative Example 1

The procedure for preparation of the toner in Example 1 was repeated except that the modified layered inorganic material (CLAYTON APA) was not added. Thus, a toner of Comparative Example 1 was prepared. The properties of the toner are shown in Table 1.

Comparative Example 2

The procedure for preparation of the toner in Example 1 was repeated except that the added amount of the modified layered inorganic material (CLAYTON APA) was changed from 3 parts to 10 parts. As a result, the viscosity of the toner composition liquid was very high, and therefore the emulsification or dispersion operation could not be performed. Accordingly, a toner could not be prepared.

Comparative Example 3

The procedure for preparation of the toner in Example 1 was repeated except that the modified layered inorganic material (CLAYTON APA) was replaced with a unmodified layered montmorillonite (KUNIPIA from Kunimine Kogyo Co., Ltd.).

Thus, a toner of Comparative Example 3 was prepared. The properties of the toner are shown in Table 1.

Each of the toners was evaluated as follows.

1. Volume Average Particle Diameter (Dv) and Number Average Particle Diameter (Dn)

The volume average particle diameter (Dv) and number average particle diameter (Dn) of the toners were determined by a particle diameter measuring instrument, MULTISIZER III from Beckman Coulter Inc., and an analysis software MULTISIZER 3 Version 3.51 from Beckman Coulter Inc. In this regard, the diameter of the aperture was 100 μm.

Specifically, the measurement method is as follows:

(1) In a 100-ml glass beaker, 0.5 g of a sample to be measured is mixed with 0.5 ml of a 10 wt % solution of a surfactant, NEOGEN SC-A from Dai-ichi Kogyo Seiyaku Co., Ltd., which is an alkylbenzene sulfonic acid salt;

(2) After the mixture is dispersed using a micro spatula, 80 ml of ion-exchange water is added thereto;

(3) The mixture is dispersed for 10 minutes using an ultrasonic dispersing machine (W-113MK-II from Honda Electronics Co., Ltd.) to prepare a sample dispersion;

(4) The volume average particle diameter (Dv) and number average particle diameter (Dn) of the sample in the dispersion are determined using the measuring instrument mentioned above and a medium (ISOTON III from Beckman Coulter Inc.).

In this regard, it is important that the sample dispersion is added into the medium so that the concentration of the dispersion indicated by the measuring instrument is 8±2% to precisely determine the volume average particle diameter (Dv) and number average particle diameter (Dn).

2. Cleanability of Toner

The procedure for evaluating the cleanability of a toner is as follows.

(1) The toners and an image forming apparatus (IMAGIO NEO C600 from Ricoh Co., Ltd.) are allowed to settle for one day in a chamber controlled at 25° C. and 50% RH.

(2) The process cartridge of the image forming apparatus is detached therefrom, and the toner included in the developer in the developing device of the process cartridge is removed so that only carrier is contained in the developing device.

(3) Twenty eight (28) grams of a toner is mixed with the carrier to prepare 400 g of a developer including the toner at a concentration of 7% by weight.

(4) The process cartridge is attached to the image forming apparatus and the developing device is idled for 5 minutes, wherein the developing sleeve is rotated at a linear speed of 300 mm/s.

(5) The developing sleeve and the photoreceptor are rotated so as to trail after the other, wherein the potential of the photoreceptor and the developing bias are adjusted so that a toner image having a weight of 0.6±0.05 mg/cm$^2$ is formed on the photoreceptor.

(6) The cleaning device of the image forming apparatus includes only one cleaning blade having an elasticity of 70%, and a thickness of 2=m, wherein the blade is set so as to counter the photoreceptor and the angle of the blade is 20°.

(7) The transfer current is adjusted so that the transfer rate of the toner image is 96±2%.

Figure 14:
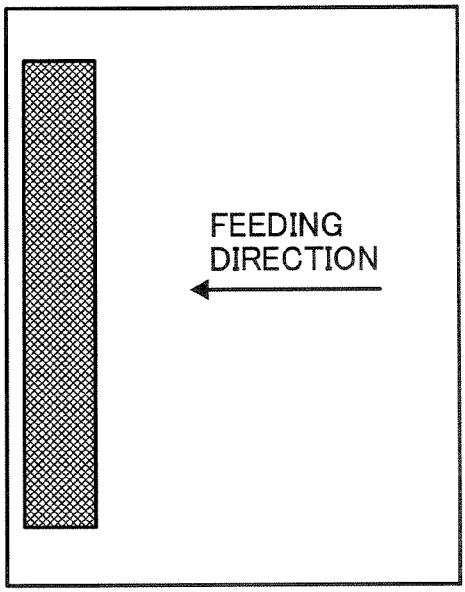
FIG. 14 illustrates a chart used for evaluating the cleanability of the toners prepared in Examples and Comparative Examples.

(8) One thousand (1,000) copies of an original image, which is illustrated in FIG. 14 and which includes a black solid image of 4 cm long and 25 cm wide, are produced under the above-mentioned conditions.

(9) A central portion (white portion) of the $1000^{th}$ copy is visually observed to determine whether the portion has an abnormal image due to defective cleaning.

(10) In addition, the optical densities of the white portion and a reference (i.e., a non-printed sheet of the receiving material) are measured with a densitometer (X-Rite 938 from X-Rite Inc.) to determine the difference between the optical densities.

(11) The cleanability of the toners is graded as follows.

○: The optical density difference is not greater than 0.01. (good)

X: The optical density difference is greater than 0.01. (bad)

In this regard, the photoreceptor of the image forming apparatus has a protective layer, which was prepared as follows.

The following components were mixed to prepare a protective layer coating liquid.

| | |
|---|---|
| Methyltrimethoxysilane | 182 parts |
| Dihydroxymethyltriphenylamine | 40 parts |
| 2-propanol | 225 parts |
| 2% acetic acid | 106 parts |
| Aluminumtrisacetylacetonate | 1 part |

The thus prepared coating liquid was coated on a charge transport layer, and then dried. Further the formed layer was heated for 1 hour at 110° C. to be crosslinked. Thus, a protective layer having a thickness of 3 μm was prepared.

The results are shown in Table 1.

| | Toners | | | | | | |
|---|---|---|---|---|---|---|---|
| Content of toner particles | Ex. 1 | Ex. 2 | Ex. 3 | Ex. 4 | Ex. 5 | Comp. Ex. 1 | Comp. Ex. 3 |
| SF-1 ≧ 115 ($C_{SF1-115}$) | 96.37 | 97.32 | 95.07 | 98.86 | 98.25 | 95.00 | 95.69 |
| SF-2 ≧ 115 ($C_{SF2-115}$) | 85.96 | 83.93 | 67.81 | 69.32 | 68.42 | 32.26 | 56.90 |
| SF-1 ≧ 120 ($C_{SF1-120}$) | 90.32 | 83.04 | 79.58 | 94.32 | 88.89 | 80.83 | 83.62 |
| SF-2 ≧ 120 ($C_{SF2-120}$) | 58.99 | 62.50 | 47.95 | 48.30 | 35.67 | 9.68 | 35.34 |
| SF-1 ≧ 140 ($C_{SF1-140}$) | 38.71 | 28.57 | 19.01 | 42.61 | 43.27 | 38.33 | 44.83 |
| SF-2 ≧ 140 ($C_{SF2-140}$) | 6.74 | 8.04 | 6.85 | 6.82 | 3.51 | 0.00 | 5.17 |
| SF-1 ≧ 145 ($C_{SF1-145}$) | 35.48 | 23.21 | 17.61 | 32.95 | 35.67 | 27.50 | 36.21 |
| SF-2 ≧ 145 ($C_{SF2-145}$) | 3.93 | 7.14 | 4.11 | 4.55 | 1.17 | 0.00 | 4.31 |
| SF-1 ≧ 165 ($C_{SF1-165}$) | 12.90 | 9.82 | 4.93 | 10.23 | 8.77 | 10.83 | 25.00 |
| SF-2 ≧ 165 ($C_{SF2-165}$) | 0.56 | 0,89 | 0.68 | 0.57 | 0.00 | 0.00 | 0.86 |
| Ave. of SF-1 | 136.27 | 141.87 | 132.18 | 141.62 | 141.00 | 138.00 | 148.00 |
| Ave. of SF-2 | 125.29 | 123.74 | 122.38 | 123.11 | 120.00 | 116.46 | 120.00 |
| Content of 4 μm or less particles ($C_4$) | 21.30 | 28.40 | 23.90 | 30.00 | 22.30 | 22.60 | 28.10 |
| Volume average particle diameter (Dv) | 5.30 | 5.50 | 5.00 | 5.20 | 5.20 | 5.40 | 5.10 |
| Cleanability | ○ | ○ | ○ | ○ | ○ | X | X |

The results are illustrated in FIGS. 15-19.

Figure 15:
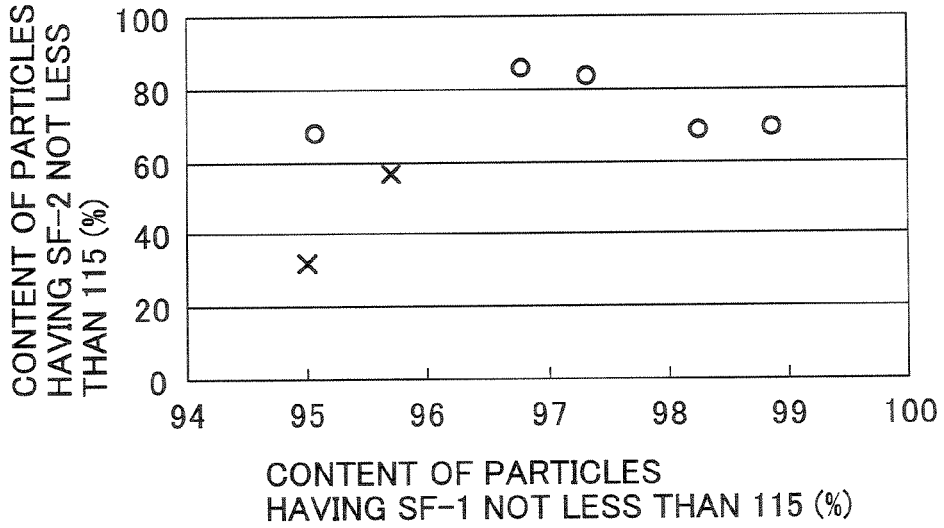
FIGS. 15-19 are schematic views illustrating the relationships between the shapes (SF-1 and SF-2) of toners and the cleanability of the toners.
Figure 16:
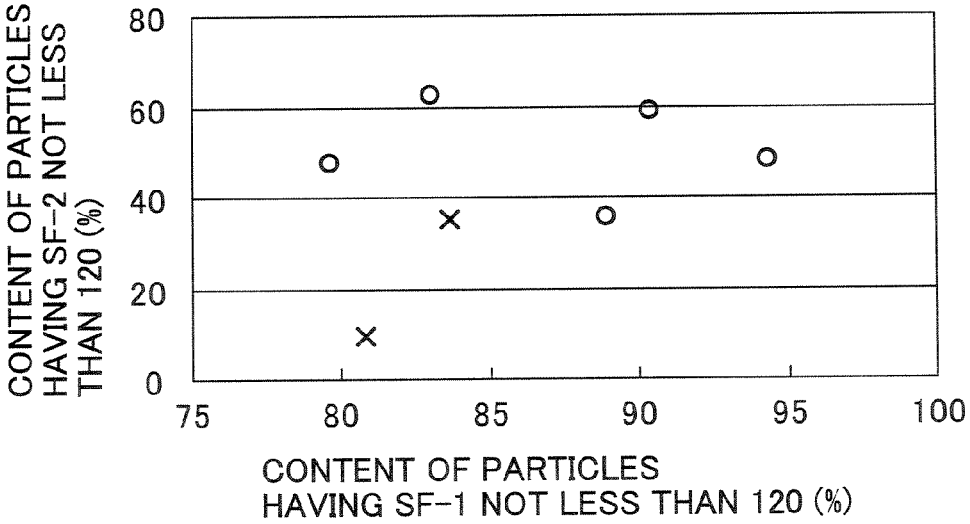
Figure 17:
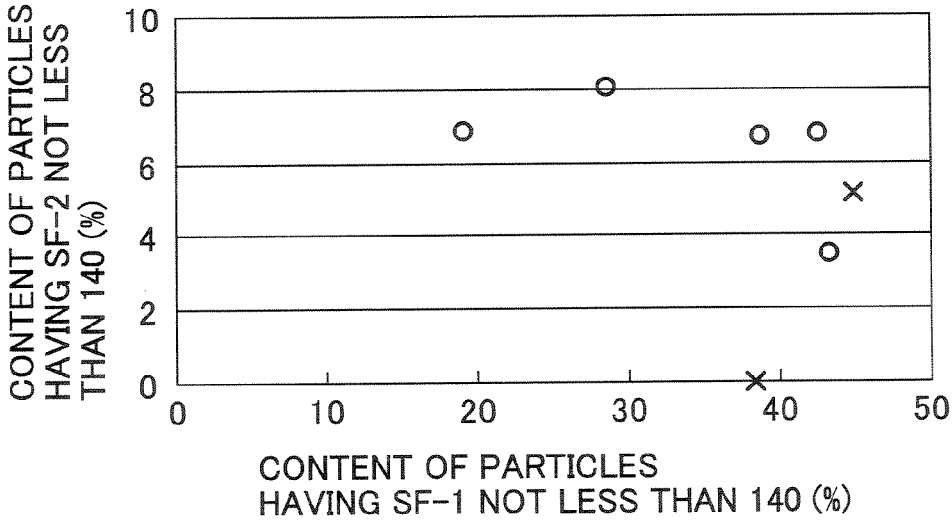
Figure 18:
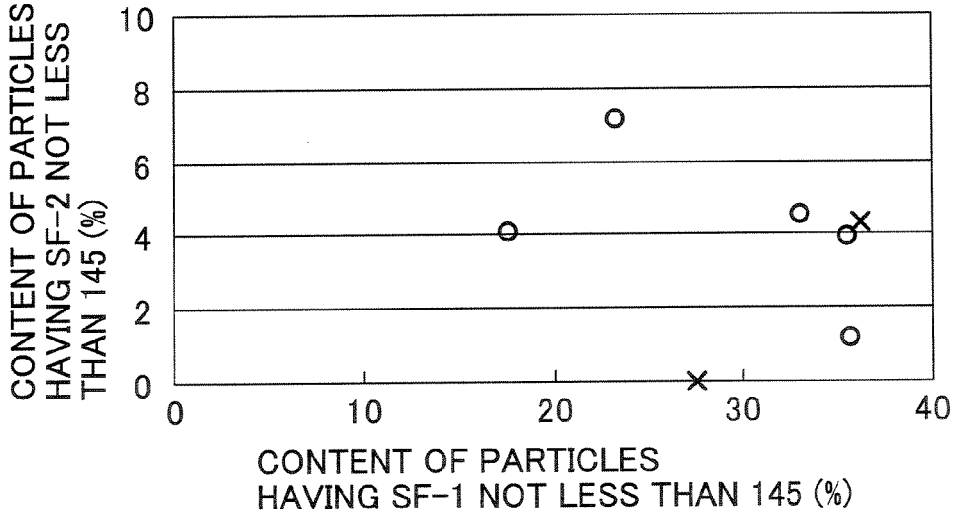
Figure 19:
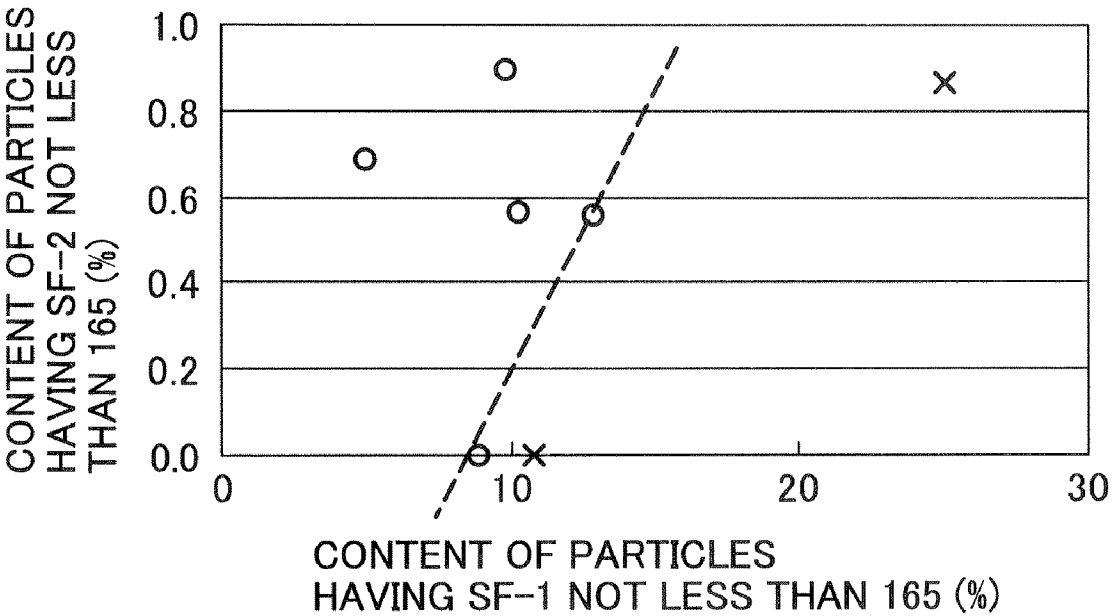

For example, in FIG. 15 the content (%) of particles having a SF-1 of not less than 115 is plotted on the horizontal axis, and the content (%) of particles having a SF-2of not less than 115 is plotted on the vertical axis. In FIG. 15, the circle mark (○) means that the toner has good cleanability, and the cross mark (X) means that the toner has bad cleanability. In FIGS. 16-19, the values of the SF-1 and SF-2 in the horizontal and vertical axes are changed to 120, 140, 145, and 165, respectively.

It is clear from FIGS. 15-19 that when the toner satisfies one of the following requirements 1)-5), the toner has good cleanability.

1) 5.0 μm<Dv<5.5 μm;
$C_4 \geqq 20\%$ by number;
1.00<SF-1/SF-2<1.15; and
$C_{SF2\text{-}115} \geqq 67.8\%$ by number.
2) 5.0 μm<Dv<5.5 μm;
$C_4 \geqq 20\%$ by number;
1.00<SF-1/SF-2<1.15; and
$C_{SF2\text{-}120} \geqq 40\%$ by number.
3) 5.0 μm<Dv<5.5 μm;
$C_4 \geqq 20\%$ by number;
1.00<SF-1/SF-2<1.15;
$C_{SF1\text{-}140} \leqq 43.27\%$ by number; and
$C_{SF2\text{-}140} \geqq 3.51\%$ by number.
4) 5.0 μm<Dv<5.5 μm;
$C_4 \geqq 20\%$ by number;
1.00<SF-1/SF-2<1.15;
$C_{SF1\text{-}145} \leqq 35.67\%$ by number; and
$C_{SF2\text{-}145} \geqq 1.17\%$ by number.
5) 5.0 μm<Dv<5.5 μm;
$C_4 \geqq 20\%$ by number;
1.00<SF-1/SF-2<1.15; and
$C_{SF2\text{-}165} \geqq 0.136 \times C_{SF1\text{-}165} - 1.1929$.

This document claims priority and contains subject matter related to Japanese Patent Application No. 2006-074534, filed on Mar. 17, 2006, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

at least one image bearing member;

a charging device configured to charge the at least one image bearing member;

a light irradiating device configured to irradiate the charged image bearing member with light to form an electrostatic latent image on the at least one image bearing member;

at least one developing device configured to develop the electrostatic latent image with a developer including a toner to form a toner image on the at least one image bearing member;

a transfer device configured to transfer the toner image onto a receiving material optionally via an intermediate transfer medium; and a cleaning device configured to remove toner particles remaining on the at least one image bearing member without being transferred, wherein the toner satisfies the following relationships (1)-(4):

$$5.0\mu m < Dv < 5.5\mu m; \quad (1)$$

$$C_4 \geqq 20\% \text{ by number}; \quad (2)$$

$$1.00 < SF\text{-}1/SF\text{-}2 < 1.15 \text{ for an average particle of the toner; and} \quad (3)$$

$$C_{SF2\text{-}115} \geqq 67.8\% \text{ by number}, \quad (4)$$

wherein Dv represents a volume average particle diameter of the toner; $C_4$ represents a content of toner particles having a particle diameter of not greater than 4.0 μm; SF-1 and SF-2 represent first and second shape factors of the toner, respectively, and $C_{SF2\text{-}115}$ represents a content of toner particles having a SF-2 of not less than 115.

2. The image forming apparatus according to claim 1, wherein the toner further satisfies the following relationship (5):

$$C_{SF2\text{-}120} \geqq 40\% \text{ by number}, \quad (5)$$

wherein $C_{SF2\text{-}120}$ represents a content of toner particles having a SF-2 of not less than 120.

3. The image forming apparatus according to claim 1, wherein the toner further satisfies the following relationships (6) and (7):

$$C_{SF1\text{-}140} \leqq 43.27\% \text{ by number}, \quad (6)$$

$$C_{SF2\text{-}140} \geqq 3.51\% \text{ by number}, \quad (7)$$

wherein $C_{SF1\text{-}140}$ represents a content of toner particles having a SF-1 of not less than 140; and $C_{SF2\text{-}140}$ represents a content of toner particles having a SF-2 of not less than 140.

4. The image forming apparatus according to claim 1, wherein the toner further satisfies the following relationships (8) and (9):

$$C_{SF1\text{-}145} \leqq 35.67\% \text{ by number}, \quad (8)$$

$$C_{SF2\text{-}145} \geqq 1.17\% \text{ by number}, \quad (9)$$

wherein $C_{SF1\text{-}145}$ represents a content of toner particles having a SF-1 of not less than 145; and $C_{SF2\text{-}145}$ represents a content of toner particles having a SF-2 of not less than 145.

5. The image forming apparatus according to claim 1, wherein the toner further satisfies the following relationship (10):

$$C_{SF2\text{-}165} \geqq 0.136 \times C_{SF1\text{-}165} - 1.1929), \quad (10)$$

wherein $C_{SF1\text{-}165}$ represents a content of toner particles having a SF-1 of not less than 165, and $C_{SF2\text{-}165}$ represents a content of toner particles having a SF-2 of not less than 165.

6. The image forming apparatus according to claim 1, including one image bearing member and plural developing devices, wherein the plural developing devices develop the electrostatic latent image with different color developers each including a toner to form color toner images on the one image bearing member.

7. The image forming apparatus according to claim 1, including plural image bearing members and plural developing devices, wherein the plural developing devices develop the electrostatic latent images on the respective image bearing members with respective color developers including different color toners to form color toner images on the plural image bearing members.

8. The image forming apparatus according to claim 1, wherein the transfer device includes a transfer belt configured to transfer the toner image onto the receiving material while feeding the receiving material.

9. The image forming apparatus according to claim 1, wherein the image bearing member is a photoreceptor selected from the group consisting of photoreceptors having a filler-reinforced outermost layer, photoreceptors including a crosslinked charge transport material, and photoreceptors having a filler-reinforced outermost layer and including a crosslinked charge transport material.

10. The image forming apparatus according to claim 1, wherein the image bearing member is an amorphous silicon photoreceptor.

11. The image forming apparatus according to claim 1, wherein the at least one image bearing member, and at least one of the charging device, the developing device, and the cleaning device are unitized to be detachably attached to the image forming apparatus as a process cartridge.

12. A toner comprising toner particles, wherein the toner satisfies the following relationships (1)-(4):

$$5.0\mu m < Dv < 5.5\mu m; \quad (1)$$

$$C_4 \geqq 20\% \text{ by number}; \quad (2)$$

$$1.00 < SF\text{-}1/SF\text{-}2 < 1.15 \text{ for an average particle of the toner; and} \quad (3)$$

$$C_{SF2\text{-}115} \geqq 67.8\% \text{ by number}, \quad (4)$$

wherein Dv represents a volume average particle diameter of the toner; $C_4$ represents a content of toner particles having a particle diameter of not greater than 4.0 μm; SF-1 and SF-2 represent first and second shape factors of the toner, respectively, and $C_{SF2\text{-}115}$ represents a content of toner particles having a SF-2 of not less than 115.

13. The toner according to claim 12, wherein the toner further satisfies the following relationship (5):

$$C_{SF2\text{-}120} \geqq 40\% \text{ by number}, \quad (5)$$

wherein $C_{SF2\text{-}120}$ represents a content of toner particles having a SF-2 of not less than 120.

14. The toner according to claim 12, wherein the toner further satisfies the following relationships (6) and (7):

$$C_{SF1\text{-}140} \leqq 43.27\% \text{ by number}, \quad (6)$$

$$C_{SF2\text{-}140} \geqq 3.51\% \text{ by number}, \quad (7)$$

wherein $C_{SF1\text{-}140}$ represents a content of toner particles having a SF-1 of not less than 140; and $C_{SF2\text{-}140}$ represents a content of toner particles having a SF-2 of not less than 140.

15. The toner according to claim 12, wherein the toner further satisfies the following relationships (8) and (9):

$$C_{SF1\text{-}145} \leqq 35.67\% \text{ by number}, \quad (8)$$

$$C_{SF2\text{-}145} \geqq 1.17\% \text{ by number}, \quad (9)$$

wherein $C_{SF1\text{-}145}$ represents a content of toner particles having a SF-1 of not less than 145; and $C_{SF2\text{-}145}$ represents a content of toner particles having a SF-2 of not less than 145.

16. The toner according to claim 12, wherein the toner further satisfies the following relationship (10):

$$C_{SF2\text{-}165} \geqq 0.136 \times C_{SF1\text{-}165} - 1.1929), \quad (10)$$

wherein $C_{SF1\text{-}165}$ represents a content of toner particles having a SF-1 of not less than 165, and $C_{SF1\text{-}165}$ represents a content of toner particles having a SF-2 of not less than 165.

17. The toner according to claim 12, wherein the toner further satisfies the following relationship (11):

$$1.00 \leqq Dv/Dn \leqq 1.40, \quad (11)$$

wherein Dn represents a number average particle diameter of the toner.

18. The toner according to claim 12, wherein the toner further satisfies the following relationship (12):

$$1\% \text{ by number} \leqq C_2 \leqq 10\% \text{ by number}, \quad (12)$$

wherein $C_2$ represents a content of toner particles having a particle diameter of not greater than 2 μm.

19. The toner according to claim 12, wherein the toner is prepared by a method comprising:

dissolving or dispersing, in an organic solvent, toner constituents including at least a binder resin, a modified polyester prepolymer, a compound capable of reacting with the prepolymer to cause at least one of a molecular chain growth reaction and a crosslinking reaction of the prepolymer, a colorant, a release agent, and a modified layered inorganic material in which at least a part of interlayer ions is replaced with an organic ion to prepare a toner composition liquid having a Casson yield value of from 1 to 100 Pa at 25° C.;

subjecting the toner composition liquid to at least one of a molecular chain growth reaction and a crosslinking reaction in an aqueous medium to prepare a dispersion; and removing at least the organic solvent from the dispersion to prepare toner particles.

20. The toner according to claim 19, wherein the modified layered inorganic material is included in the toner composition liquid in an amount of from 0.05 to 10% by weight based on total weight of solid components included in the toner composition liquid.

21. The toner according to claim 12, further comprising an external additive which includes a particulate material having an average primary particle diameter of from 50 to 500 nm, a bulk density of not less than 0.3 g/cm$^3$ and which is present on a surface of the toner particles.

22. A process cartridge comprising:

an image bearing member bearing an electrostatic latent image thereon; and a developing device configured to develop the electrostatic latent image with a developer including a toner to form a toner image on the image bearing member, wherein the toner satisfies the following relationships (1)-(4):

$$5.0\mu m < Dv < 5.5\mu m; \quad 1$$

$$C_4 \geqq 20\% \text{ by number}; \quad (2)$$

$$1.00 < SF\text{-}1/SF\text{-}2 < 1.15 \text{ for an average particle of the toner; and} \quad (3)$$

$$C_{SF2\text{-}115} \geqq 67.8\% \text{ by number}, \quad (4)$$

wherein Dv represents a volume average particle diameter of the toner; $C_4$ represents a content of toner particles having a particle diameter of not greater than 4.0 μm; SF-1 and SF-2 represent first and second shape factors of the toner, respectively, and $C_{SF2\text{-}115}$ represents a content of toner particles having a SF-2 of not less than 115.

* * * * *